US008035025B1

(12) United States Patent
Donnell

(10) Patent No.: US 8,035,025 B1
(45) Date of Patent: Oct. 11, 2011

(54) ACOUSTIC MUSICAL INSTRUMENT WITH TRANSDUCERS

(76) Inventor: Kenneth D. Donnell, Greenville, CA (US)

( * ) Notice: Subject to any disclaimer, the term of this patent is extended or adjusted under 35 U.S.C. 154(b) by 242 days.

(21) Appl. No.: 12/290,156

(22) Filed: Oct. 27, 2008

(51) Int. Cl.
*G10H 3/00* (2006.01)

(52) U.S. Cl. ..... 84/723; 84/290

(58) Field of Classification Search ..... 84/723, 84/290, 291, 280, 281, 173, 267–269, 274–277, 84/306–309, 327, 329
See application file for complete search history.

(56) References Cited

U.S. PATENT DOCUMENTS

| | | | | |
|---|---|---|---|---|
| 2,113,446 | A * | 4/1938 | Gugino | 84/293 |
| 2,304,597 | A | 12/1942 | Proelsdorfer | |
| 3,858,480 | A | 1/1975 | Schneider et al. | |
| 4,056,034 | A | 11/1977 | Kaman | |
| 4,351,217 | A | 9/1982 | Wechter | |
| 4,501,186 | A * | 2/1985 | Ikuma | 84/726 |
| 4,534,258 | A * | 8/1985 | Anderson | 84/728 |
| 4,748,886 | A | 6/1988 | De Byl | |
| 5,010,803 | A | 4/1991 | Donnell | |
| 5,252,777 | A | 10/1993 | Allen | |
| 5,469,770 | A | 11/1995 | Taylor | |
| 5,614,688 | A | 3/1997 | Donnell | |
| 6,100,458 | A * | 8/2000 | Carrington et al. | 84/293 |
| 6,441,292 | B1 | 8/2002 | Donnell | |
| 7,687,696 | B2 * | 3/2010 | Fox | 84/290 |
| 2006/0032364 | A1 * | 2/2006 | Ludwig | 84/723 |

* cited by examiner

*Primary Examiner* — Jianchun Qin
(74) *Attorney, Agent, or Firm* — Haverstock & Owens, LLP

(57) ABSTRACT

A stringed musical instrument may include various features, including any of a soundboard designed for efficient production of acoustic tone, a removable cover for easy access to the instrument's interior, a tailpiece mounted to receive and tension strings, one or more transducers to record and amplify musical tones, a dampening device that further improves operation of the transducers, a detachable thumbrest, an overbrace to strengthen supporting cross members that embody openings, and a rigid overlay that may be placed over an original fretted fingerboard to create a fretless surface for the strings to contact.

20 Claims, 27 Drawing Sheets

ACOUSTIC MUSICAL INSTRUMENT WITH TRANSDUCERS

This application claims the benefit of U.S. Provisional Application Ser. No. 60/000,591, filed on Oct. 25, 2007, the contents of which are incorporated by reference herein.

TECHNICAL FIELD

The present invention relates generally to musical instruments, and more particularly to stringed musical instruments.

BACKGROUND OF THE INVENTION

The recorded history of stringed musical instrument construction includes many designs claiming to influence tone production, including devices to record and/or transducer natural acoustic tones into an electronic signal for amplification. The soundboard can be the principal tone producing member of most stringed musical instruments, and many designs for soundboard construction are recorded, such as Taylor in U.S. Pat. No. 5,469,770.

Most prior art designs for fretted instruments depict a single circular soundhole in the instrument's body, or soundbox. Kaman, in U.S. Pat. No. 4,056,034 records a guitar soundboard with two circular soundholes positioned on either side of a fingerboard.

It is often necessary to perform repairs and modifications within the body, or soundbox of a stringed musical instrument. Wechter, in U.S. Pat. No. 4,351,217 records a removable panel located in the tailblock.

Most recorded designs for stringed instruments employ tuning devices (tuners) mounted onto a peghead, and fretted instruments often show geared tuners being used for tensioning the strings. One example of geared tuners being attached to a stringed instrument body is documented by Schneider in U.S. Pat. No. 3,858,480.

Proelsdorfer's U.S. Pat. No. 2,304,597, records secondary tuning devices mounted onto a tailpiece for a bowed instrument. Primary tensioning of the strings is performed by tuners attached on the end of a traditional peghead. Secondary tuning devices are designed as a pivoted bell lever controlled by a downward pushing rod. Unlike geared tuners, which provide continuous tensioning of an attached string, pivoted bell lever designs can provide only a limited range of tension to a string, and are thus typically suitable only as secondary tuners for the "final tuning of the string".

Electro-magnetic transducers produce a wide variety of amplified tones according to the design of each such transducer. Having modular or interchangeable electro-magnetic transducers offers a musician the ability to create a wide variety of tonal qualities from a single stringed musical instrument. Allen, in U.S. Pat. No. 5,252,777, recorded designs for an electric guitar that includes interchangeable electro-magnetic transducers. Donnell, in U.S. Pat. No. 5,614,688, records interchangeable electro-magnetic transducers for acoustic stringed musical instruments.

Many examples of prior art record the use of microphones mounted onto or within a musical instrument for the purpose of recording acoustic tone. De Byl, in U.S. Pat. No. 4,748,886, employs a single column of foam to mount two separate microphone elements within an acoustic guitar. De Byl defines no clear location of the microphone elements within the soundbox of the stringed musical instrument, except to note that they receive acoustical energy from opposite sides of a foam column. Donnell, in U.S. U.S. Pat. No. 6,441,292 records transducers that mount multiple microphone elements on to separate flexible mounting arms of approximately equal length.

De Byl, in U.S. Pat. No. 4,748,886, also employs the foam column for the purpose of dampening acoustic musical energy in order to control electronic feedback.

DETAILED DESCRIPTION

Various embodiments of the present invention will now be described in detail with reference to a number of drawings.

The embodiments show musical instruments, including musical instrument structures and/or transducer arrangements.

Referring now to FIGS. 1, 2, 4 and 6, musical instruments according to various embodiments will be described.

Figure 1:
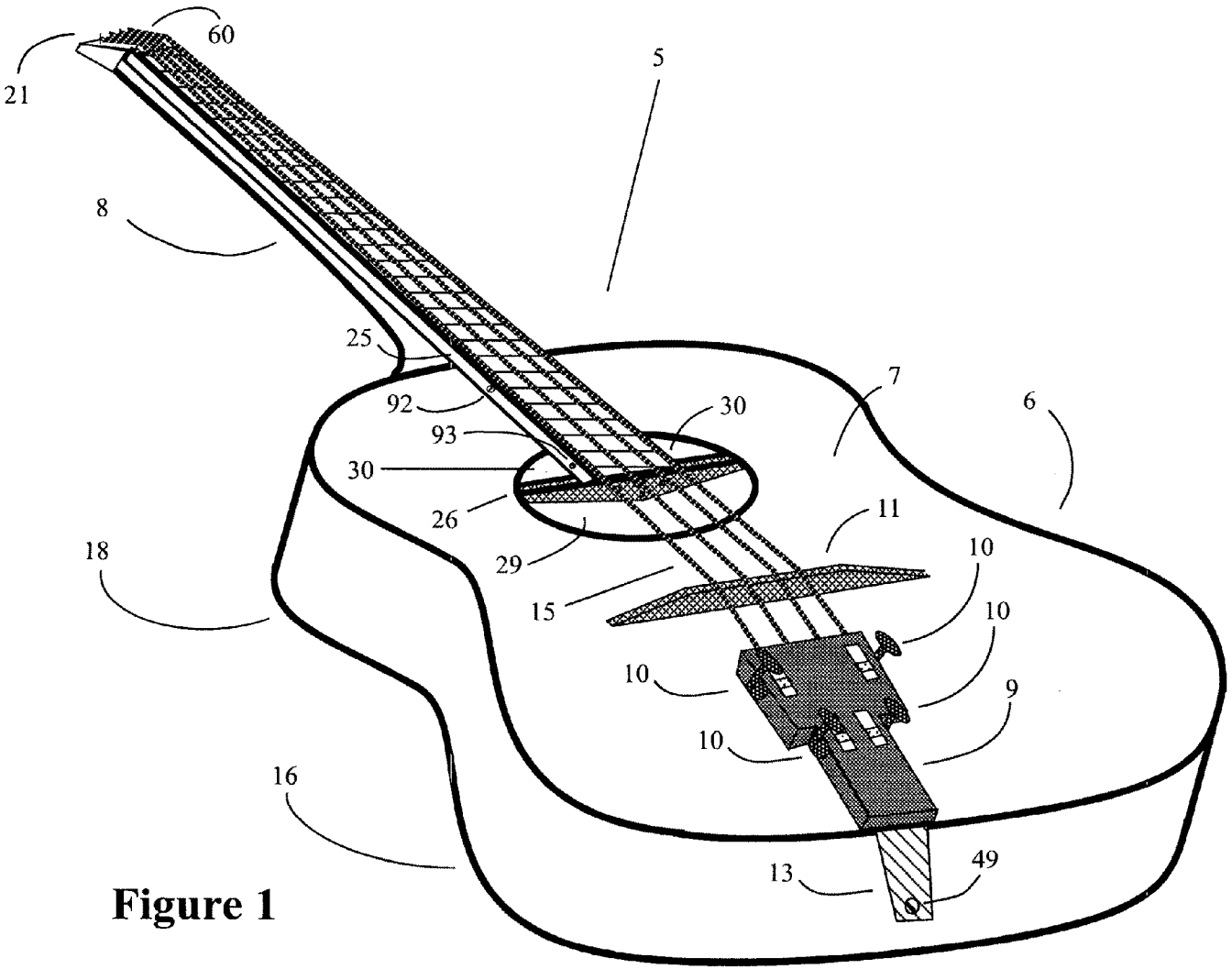
FIG. 1 is a perspective showing a musical instrument according to one embodiment.

FIG. 1 shows a four stringed musical instrument 5 with a soundbox 6 and attached neck structure 8. In the particular embodiment of FIG. 1 there is no peghead, so geared tuners 10 can be mounted onto a tailpiece 9 that may be secured to the soundbox 6 with a hinge. Strings 15 may be attached to pins located on the end of the neck structure 8 opposite the soundbox 6, pass over a bridge 11 that rests on the soundboard, and can be received by the geared tuners 10 on the tailpiece 9 for tensioning.

Figure 2:
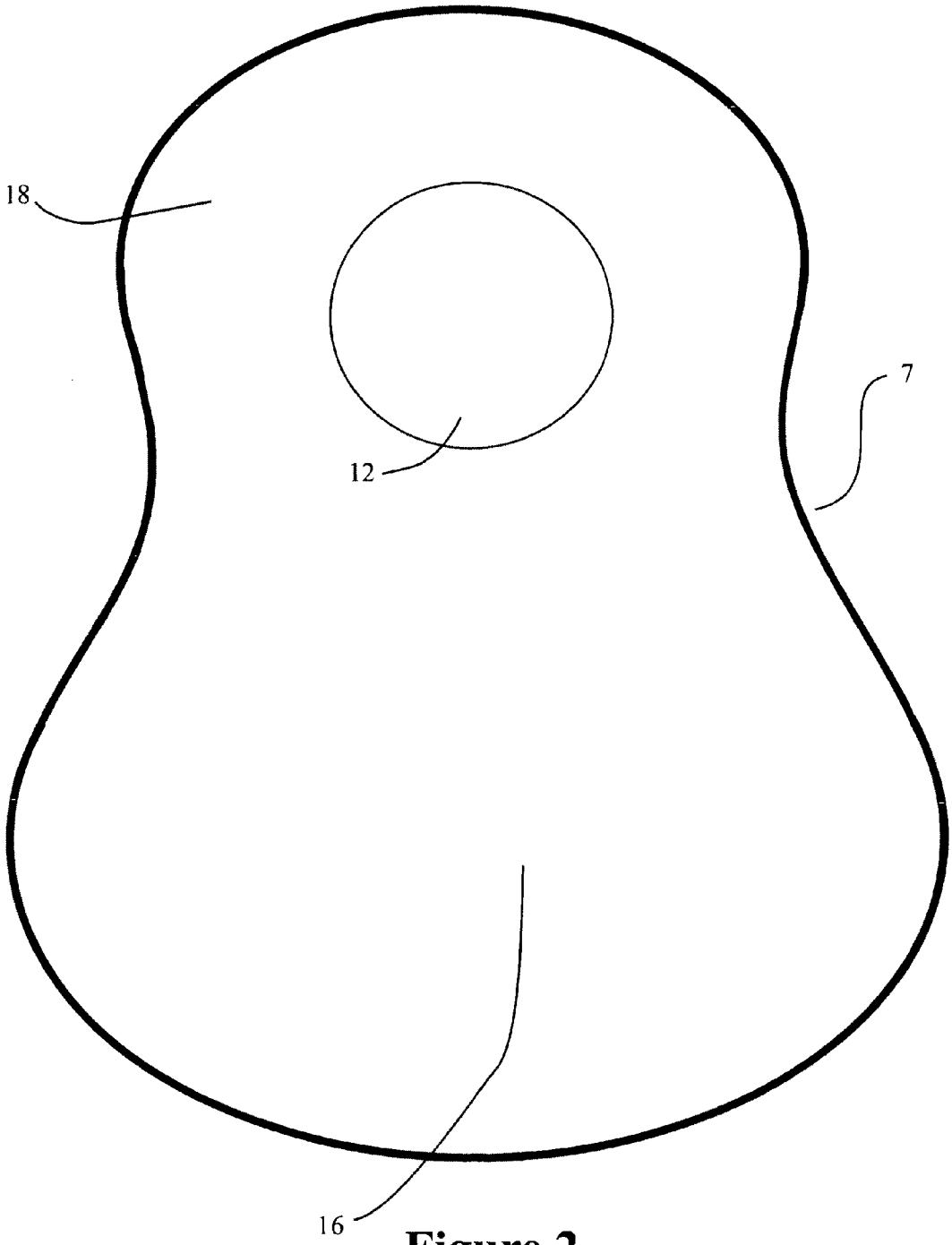
FIG. 2 is a front view of a soundboard that may be included in embodiments.

FIG. 2 shows a front view of a soundboard 7 with a single opening 12, or soundhole, and identifies general regions (lower bout 16 and upper bout 18) of the soundboard 7. In the very particular example shown, opening 12 has a circular shape.

Figure 3:
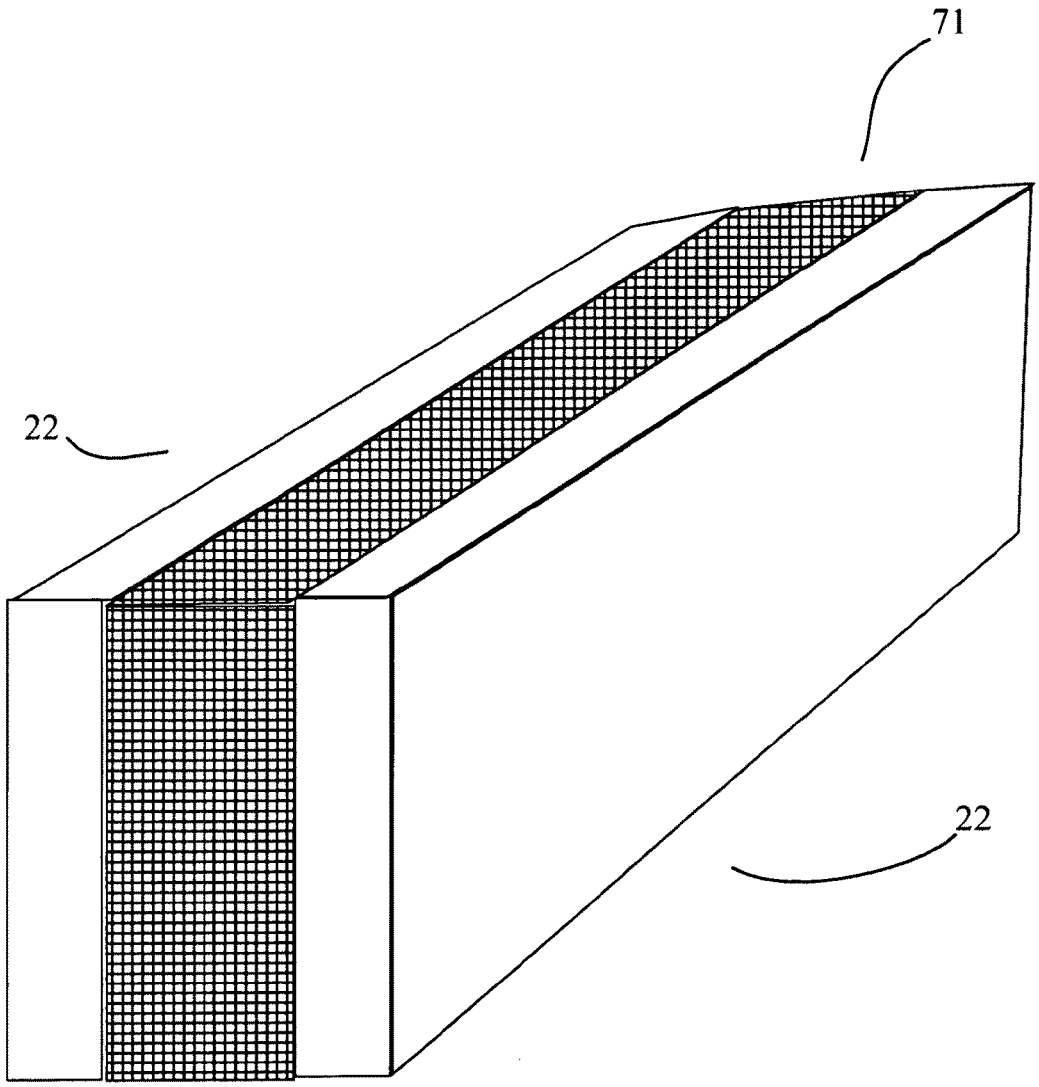
FIG. 3 is a cross sectional view of a supporting cross member (or brace) structure according to an embodiment.

FIG. 3 shows a cross sectional view of one example of a supporting cross member, or brace that may be used in the embodiments. A supporting cross member may include a center section 71 of webbing bonded between two rigid, or semi-rigid plates 22.

Figure 4:
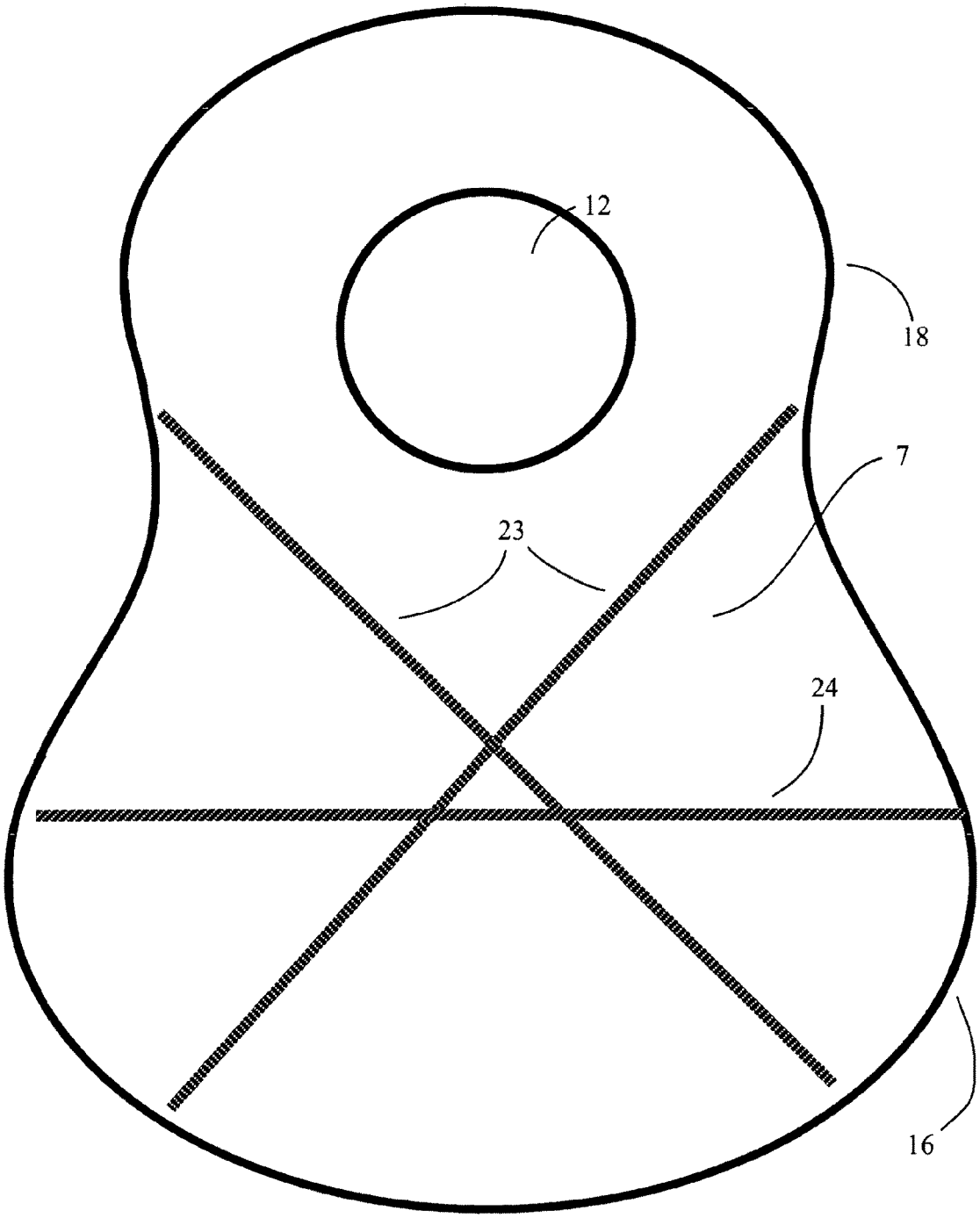
FIG. 4 is a plan view of a bracing pattern for a soundboard that may be included in embodiments.

FIG. 4 shows an underside view of one example of a soundboard 7 that can be included in embodiments. FIG. 4 shows an arrangement where two "x" braces 23, and a lateral brace 24 may be glued to the underside of the soundboard 7 in the approximate center of the lower bout 16 using an over lapping and under lapping pattern.

Figure 5:
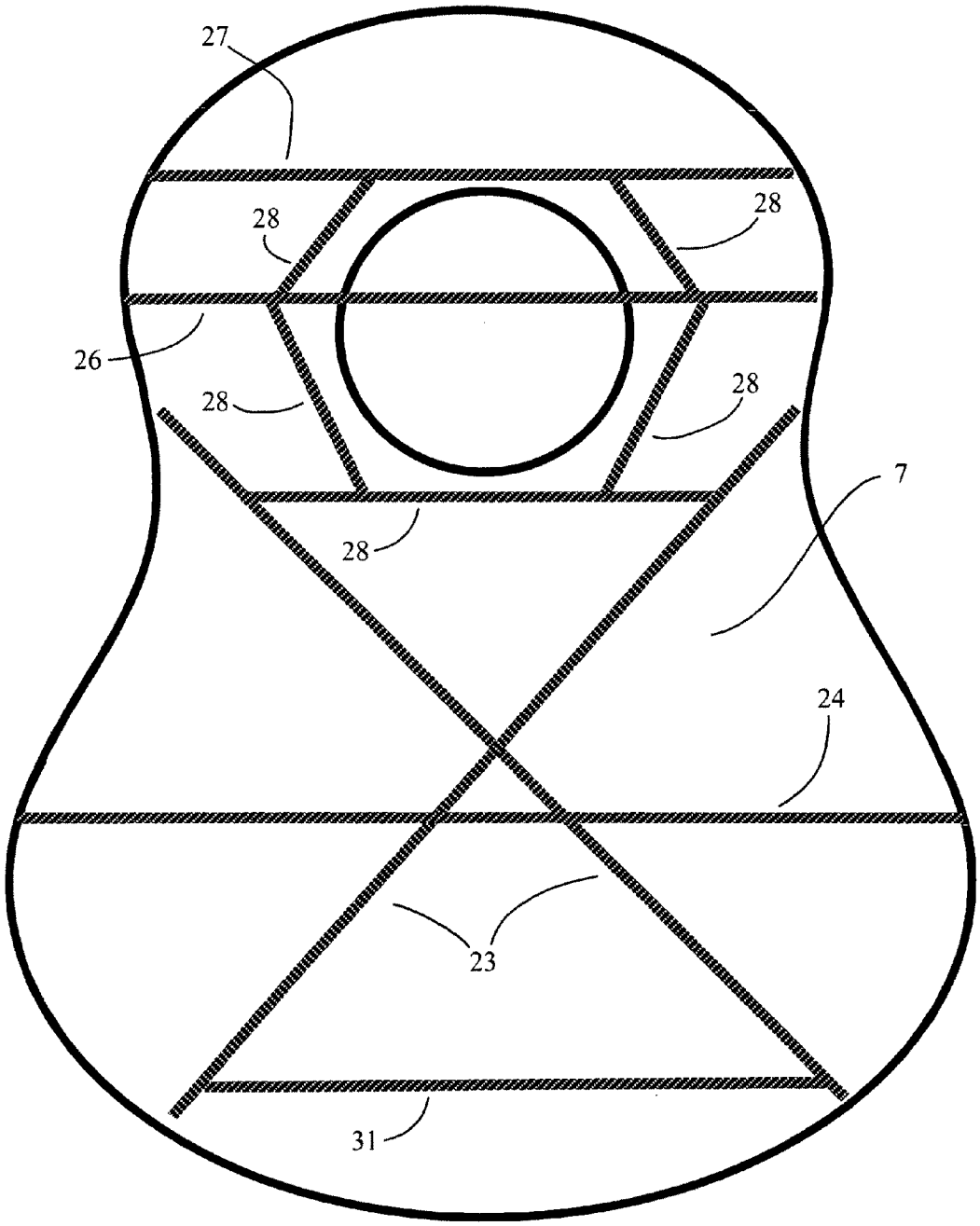
FIG. 5 is a plan view of another bracing pattern for a soundboard that may be included in embodiments.

FIG. 5 shows an underside view of another example of a soundboard 7 that may be included in the embodiments. FIG. 5 shows a bracing pattern glued to the underside of the soundboard 7 that includes the same general pattern as FIG. 4, and in addition, includes additional lateral braces, to produce a pattern including first lateral brace 26, second lateral brace 24, third lateral brace 27, and fourth lateral brace 31. In addition or alternatively, soundhole supporting braces 28 can be formed around a periphery of soundhole 12.

Figure 6:
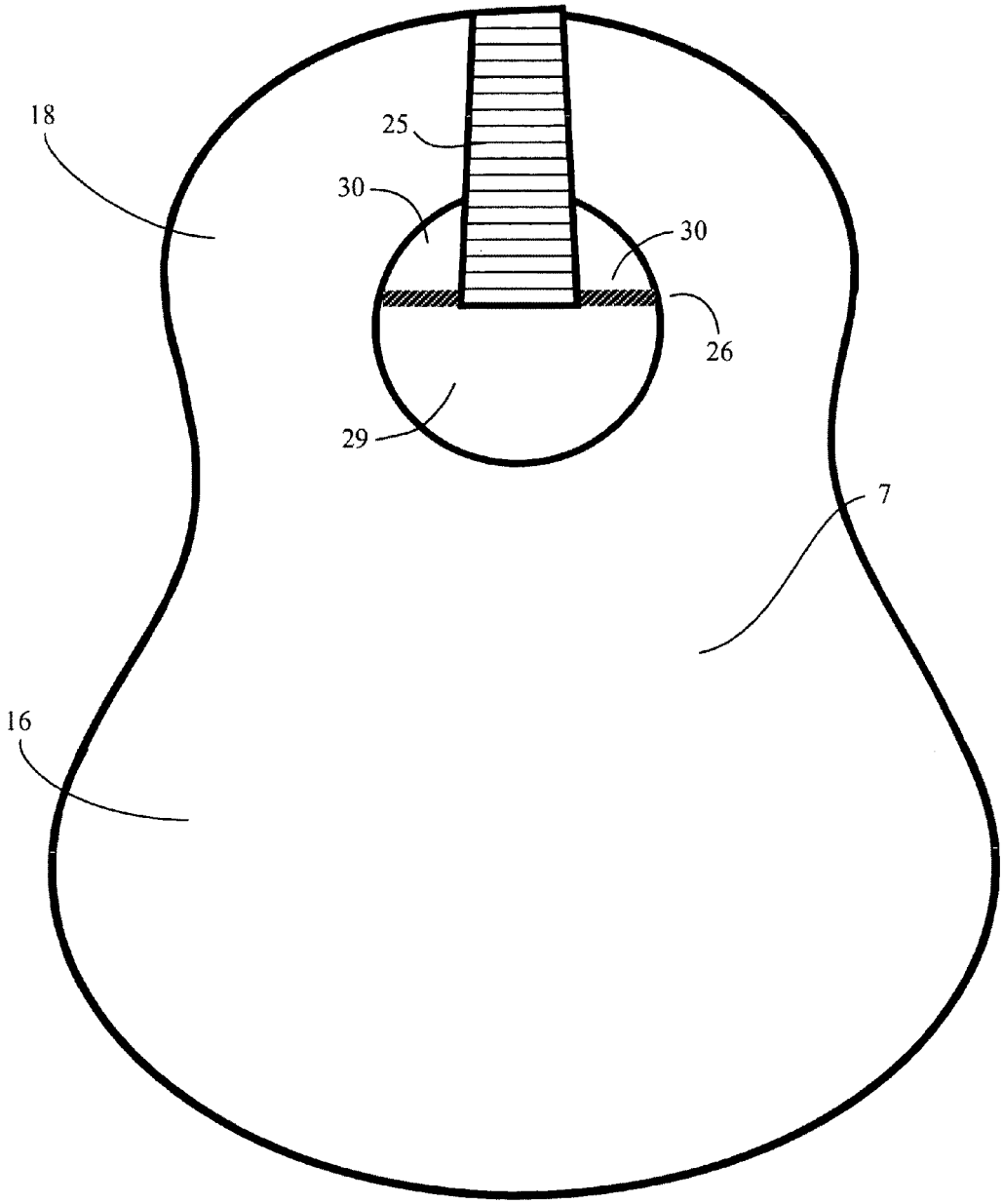
FIG. 6 is a plan view showing an exterior of a soundboard that may be included in embodiments.

FIG. 6 shows an exterior view of one example of a soundboard 7 with a fingerboard 25 installed so that one soundhole 12 is divided into three separate opening portions, including a large opening portion 29 and two smaller opening portions 30.

1. Soundboard design: Having described a musical instrument and soundboards for such instruments, various aspects of soundboard design according to embodiments will now be described with reference to FIGS. 1-6.

A soundhole 12 formed in soundboard 7 may be intersected by both the fingerboard 25, a component of the neck structure 8, and a supporting cross member in the form of a first lateral brace 26. The soundhole 12, which is originally cut as a single opening, becomes divided by the fingerboard 25 and first lateral brace 26 into one large soundhole portion 29, and two smaller soundhole portions 30. The two smaller soundhole portions 30 may permit the higher sound frequencies produced in the upper bout 18 to efficiently escape the interior of the sound box 6, while the increased surface area of the lower bout 16 may provide more efficient tone production in the lower sound frequencies.

In the particular embodiments, a pattern of supporting cross members, (i.e., braces) may be affixed to the underside of the soundboard 7, and can provide the mechanical support to counter-act the downward tension of the strings 15, and/or permit the soundboard 7 to maintain the flexibility required for the efficient production of musical tones by the stringed musical instrument 5. Two long X braces 23 can over-lap and under-lap each other approximately in the center of the lower bout 16. A second lateral brace 24 spans the width of the soundboard 7 across the lower bout 16 and may over-laps both of the X braces 23. The result is a triangular intersection of the X braces 23 and second lateral brace 24 at the approximate center of the lower bout 16, with the braces 23 and 24 radiating outward from this triangle towards the edges of the soundboard 7. Such an arrangement is shown in both FIGS. 4 and 5.

In alternate arrangement, like that shown in FIG. 6, there can also be a third lateral brace 27, a fourth lateral brace 31, and five soundhole supporting braces 28 glued to the underside of the soundboard 7.

One or more of the braces (e.g., any of 23, 24, 26, 27, 28, 31) may be constructed in a manner like that shown in FIG. 3. That is, a brace (any of 23, 24, 26, 27, 28, 31) may include a center section of webbing 71, honeycomb, or other material that embodies voids, so that the webbing 71 is bonded between two rigid or semi-rigid plates 22.

In this way, a stringed musical instrument may include a soundbox with a soundboard having braces formed with central void containing material. Such a soundboard may include a soundhole opening divided into different sized portions by a fingerboard and/or the bracing.

While embodiments may include musical instruments having bracing and soundhole division as noted above, other embodiments may additionally include soundboxes with removable covers or accessing features within such soundboxes. Particular embodiments will now be described with reference to FIGS. 7 and 8.

Figure 7:
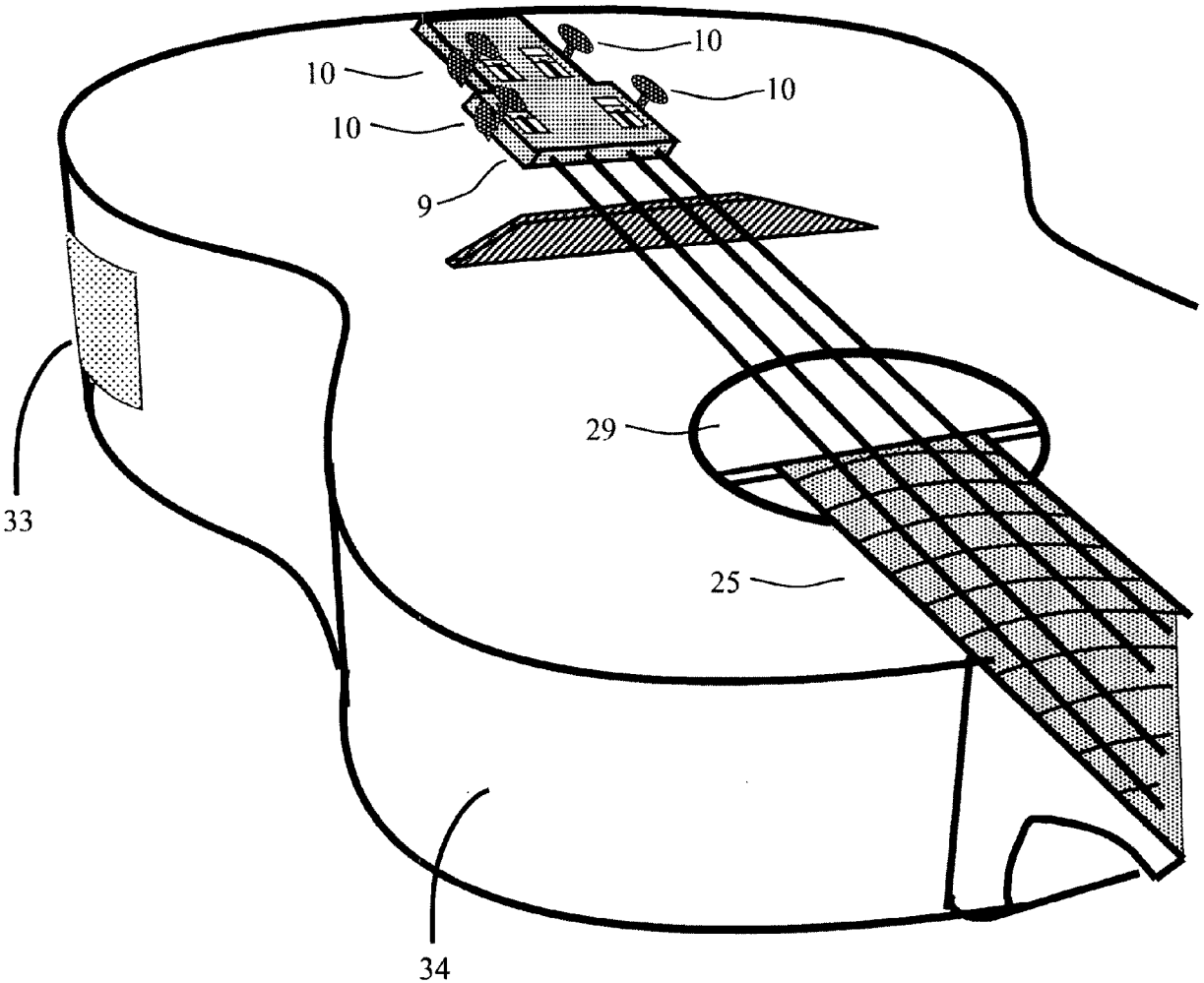
FIG. 7 is a perspective view showing a musical instrument according to another embodiment.

FIG. 7 shows one example of a stringed musical instrument 5 with a removable cover 33 attached to a rib 34 of the musical instrument 5. In particular examples, musical instrument 5 may be one example of those shown in FIGS. 1-2 and 4-6.

Figure 8:
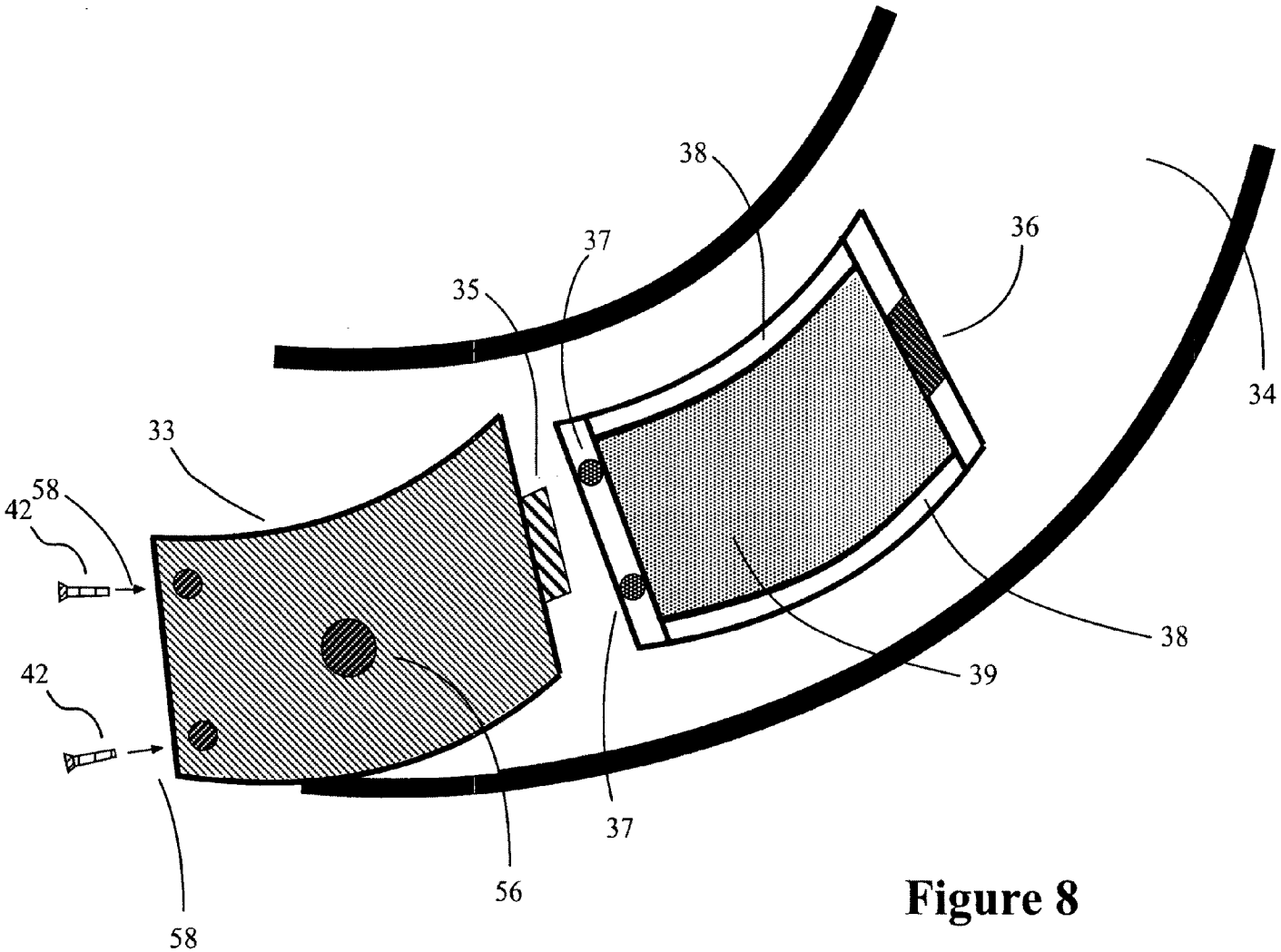
FIG. 8 is a diagram showing a removable cover that may be included in the embodiment of FIG. 7.

FIG. 8 shows a detailed view of a removable cover like that shown as 33 in FIG. 7

2. Removable Cover: Features of a removable cover according to one particular embodiment will now be described with reference to FIGS. 7 and 8.

A removable cover 33 may seal an opening 39 in a rib 34. In particular embodiments, a removable cover 33 can be composed of material identical, or similar to, the rib 34. This removable cover 33 may be secured over opening 39 by mechanical devices. In the particular example illustrated, such a mechanical device may include a wooden tongue 35 received by a groove 36 and/or machine screws 42 with inserts 37. There may also be an inner lining 38 attached to rib 34 to prevent leakage of acoustical energy from the soundbox 6. A removable cover 33 may permit easy access for adjustment, repair, or modification of components located within the interior of the soundbox 6. In some embodiments, electronic components, such as an output jack 56 may be mounted to the cover 33.

In this way, a musical instrument may include a removable cover for accessing features within a soundbox.

While embodiments may include musical instruments with bracings, removable covers, or unique soundholes designs, other embodiments may include a tailpiece for a musical instrument that enables the tuning of strings. It is understood that a tailpiece is in contrast to a conventional musical instrument having a "peghead" for tuning disposed at a distal end of a neck structure. More particularly, a tailpiece may be positioned opposite to a neck portion.

FIGS. 1 and 7 have shown examples of a tailpiece 9 having tuners 10. More particular examples of tailpieces according to embodiments are shown in FIGS. 9-13.

Figure 9:
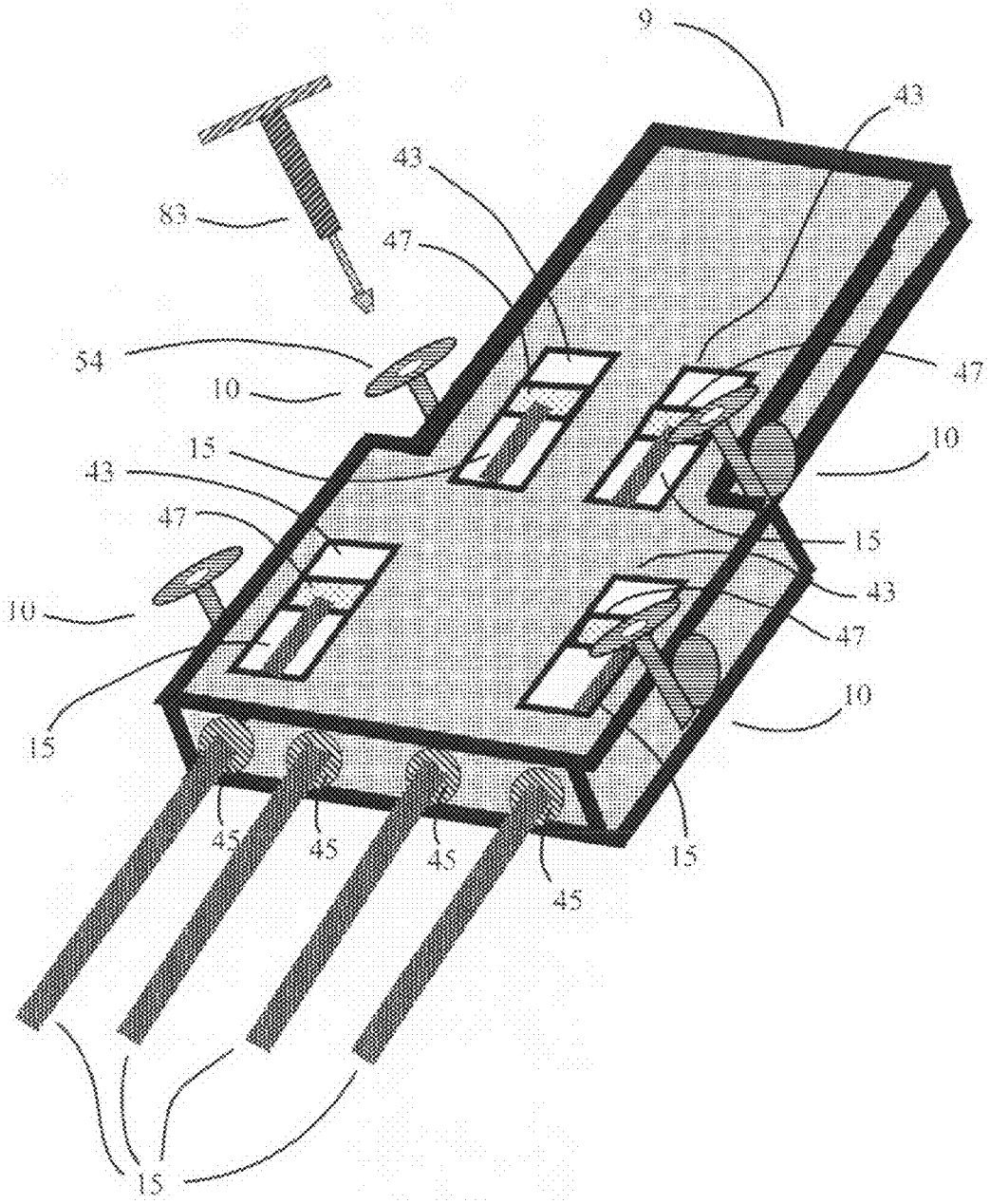
FIG. 9 is a diagram showing a tailpiece that may be included in embodiments.

FIG. 9 shows a detailed view of a tailpiece 9 according to an embodiment. Tailpiece 9 of FIG. 9 may be one example of that shown as 9 in either of FIG. 1 or 7. Referring to FIG. 9, tailpiece 9 may have tuners 10 installed and each of strings 15 may be received by a hole 45 drilled into one end of the tailpiece 9 so that strings 15 can be connected to the tuners 10. An adjusting tool 83 is shown ready to be received by an opening 54 embedded within a tuning button 54.

Figure 10:
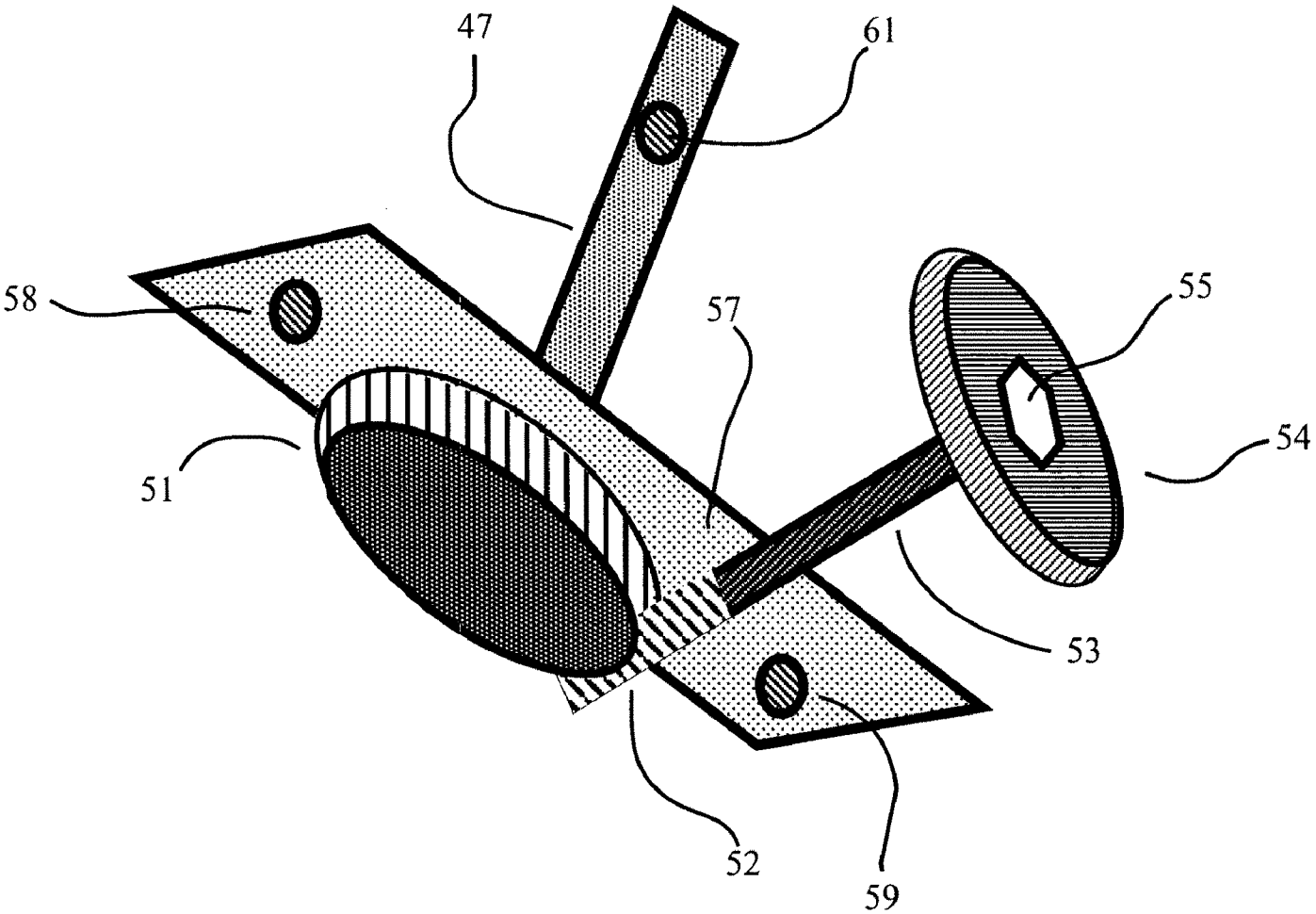
FIG. 10 is a detailed view showing a geared tuner that may be included in the embodiments.

FIG. 10 shows a detailed view of a geared tuner that can be one example of that shown as 10 in FIG. 9. Tuner 10 may have an opening 55 in the tuning button 54 to receive a tool that can improve tensioning of strings 15. Tuner 10 may also include a plate 59, toothed gear 51, and main shaft 47 with an opening 61 that may receive a string.

Figure 11:
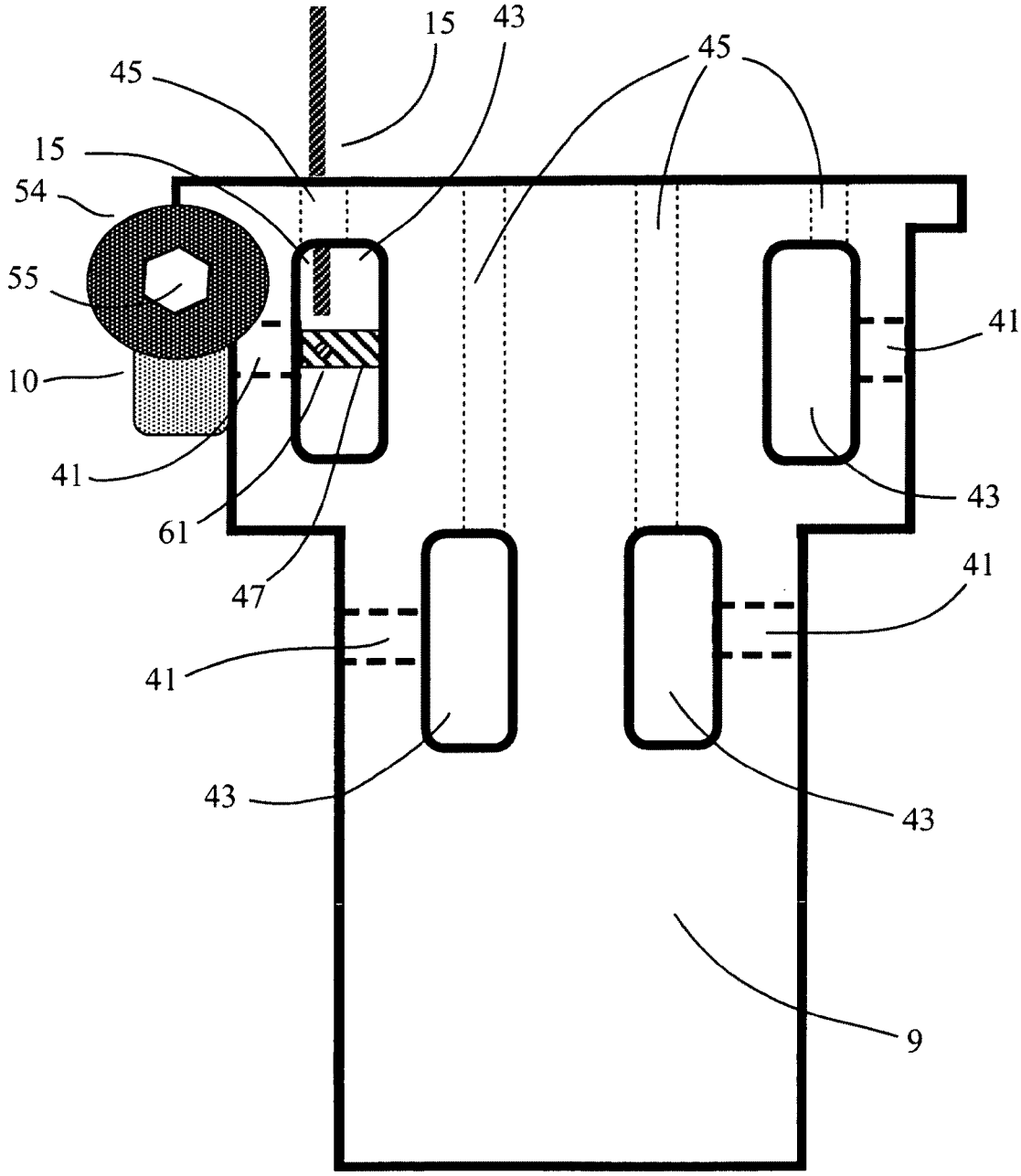
FIG. 11 is a top view of the tailpiece of shown in FIG. 9.

FIG. 11 shows a top view of a tailpiece like that of FIG. 9, where one tuner 10 is installed, and one string 15 is received by the opening 45 of the tuner's main shaft 47. Coarse dotted lines represent a first set of four holes 41 drilled through the side of the tailpiece 9 to receive the tuners 10, and fine dotted lines represent a second set of four holes 45 drilled through one end of the tailpiece to receive ends of the strings 15. Slots may be cut into a face of the tailpiece 9 that may intersect one hole 41 drilled in the side (coarse dotted line) and one hole 45 drilled from the end (fine dotted line).

Figure 12:
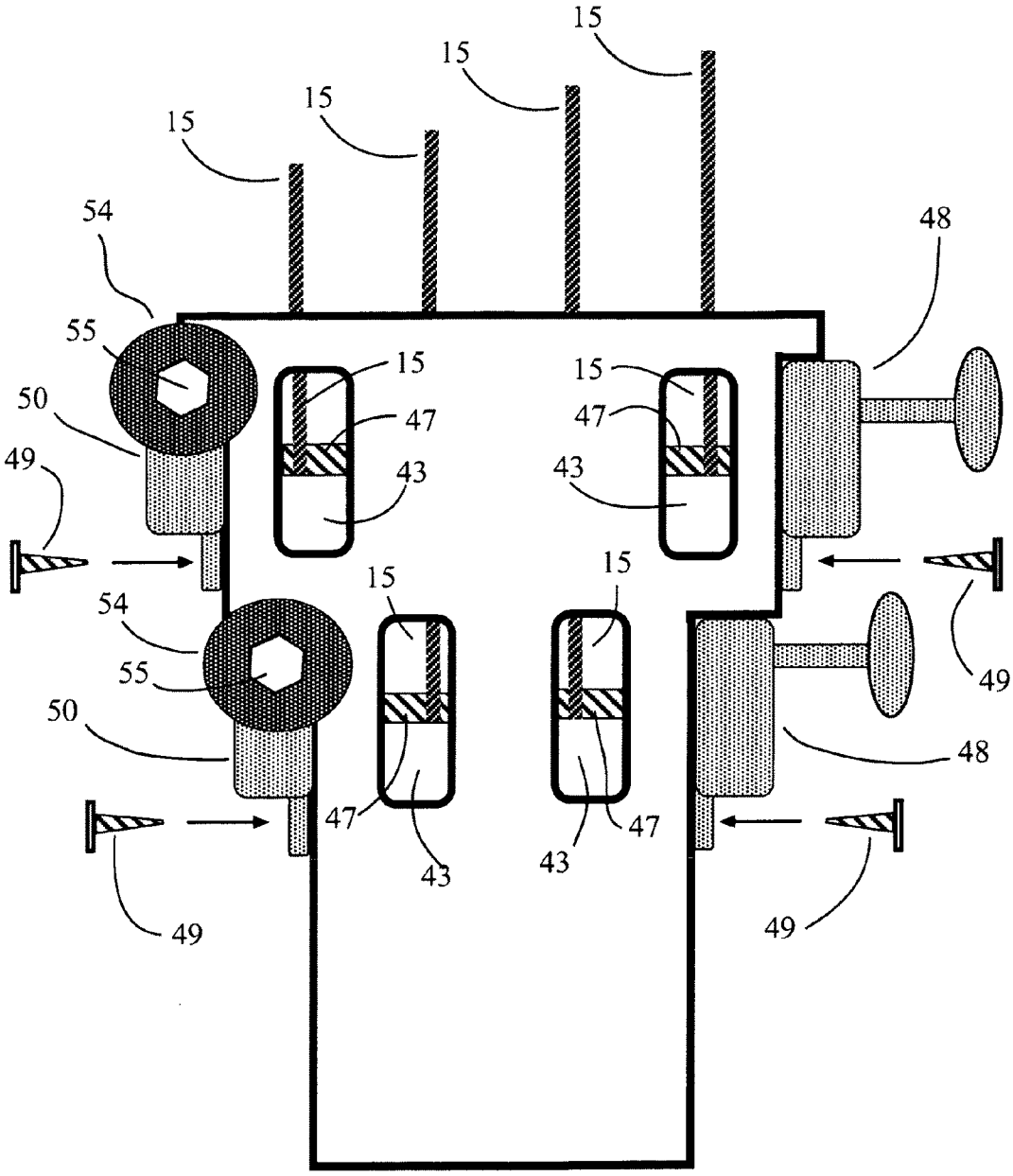
FIG. 12 is another top view of the tailpiece shown in FIG. 9.

FIG. 12 shows a tailpiece that may be one example of that shown in FIGS. 9-11. Referring to FIG. 12, in the particular example shown, a tailpiece 9 may have with two geared tuners installed on one side (right side), two planetary tuners installed on the opposite side (left side), and a single screw 49 employed to secure each tuner to the tailpiece 9.

Figure 13:
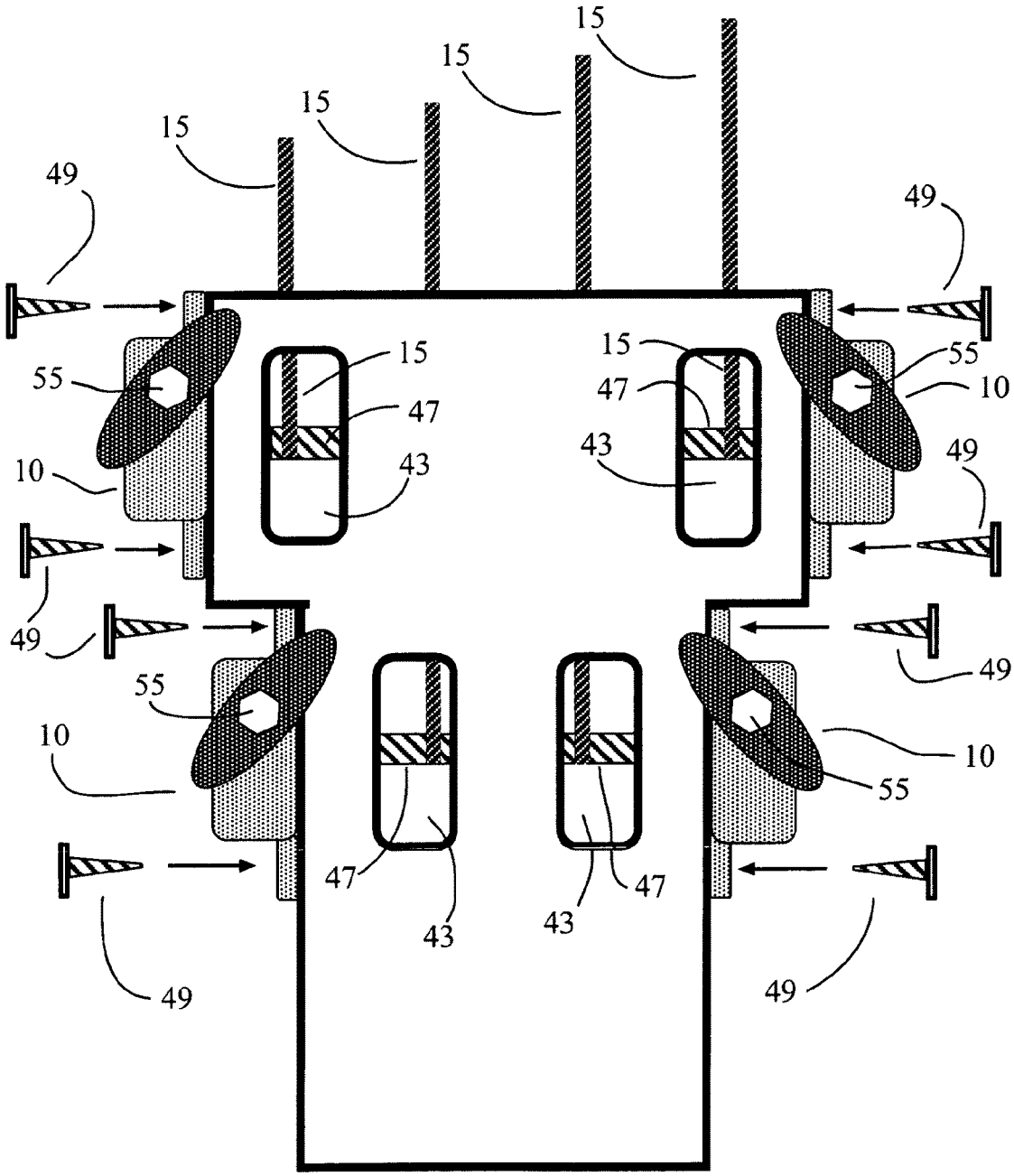
FIG. 13 is a top view of another tailpiece that may be included in the embodiments.

FIG. 13 shows a top view of a tailpiece similar to that shown in FIGS. 9, 10, 11, and 12. However, in the arrangement shown there may be two screws 49 that secure each tuner 10.

3. Tailpiece and tuners: Having described various examples of tailpieces, various aspects of tailpieces will now be described with reference to FIGS. 9-13.

Referring to FIGS. 9-13, tuners 10 may be affixed to a tailpiece 9 composed of wood, metal, or some other rigid material or combination of materials. In very particular embodiments, tuners 10 may include any of:

a. a main shaft 47, into which an opening 61 is formed to receive the plain end of a string 15, b. a toothed gear 51 affixed to the end of the main shaft 47 opposite the opening 61, c. a tuning shaft 53 with a tuning button 54 on one end that may include a geometric opening 55 to receive an adjusting tool 83 and a worm gear 52 on the opposite end so that the tuning shaft 53 is positioned at a ninety degree angle to the main shaft 47, d. a plate 57 having one or more openings 58 to receive a mounting fastener that may connect main shaft 47, toothed gear 51, and tuning shaft 53, and e. mechanisms, such as screws 49, for securing the tuner 10 to the tailpiece 9.

In very particular embodiments, a tailpiece 9 may include any of:

a. a first set of holes 41 (depicted in FIG. 11 with coarse dotted lines) formed into the side of the tailpiece 9 that may receive the main shafts 47 of the tuners 10, b. a second set of holes 45 (depicted in FIG. 11 as fine dotted lines) formed into one end of the tailpiece 9 that may receive the plain end of each string 15, and c. slots 43 formed into the face of the tailpiece 9 so that each slot 43 may expose the main shaft 47 of one tuner 10, and intersect one first hole 41 and one second hole 45 so that the plain end of a string 15 may pass through the second hole 45 and may be received by the opening 61 of the main shaft 47.

Figure 14:
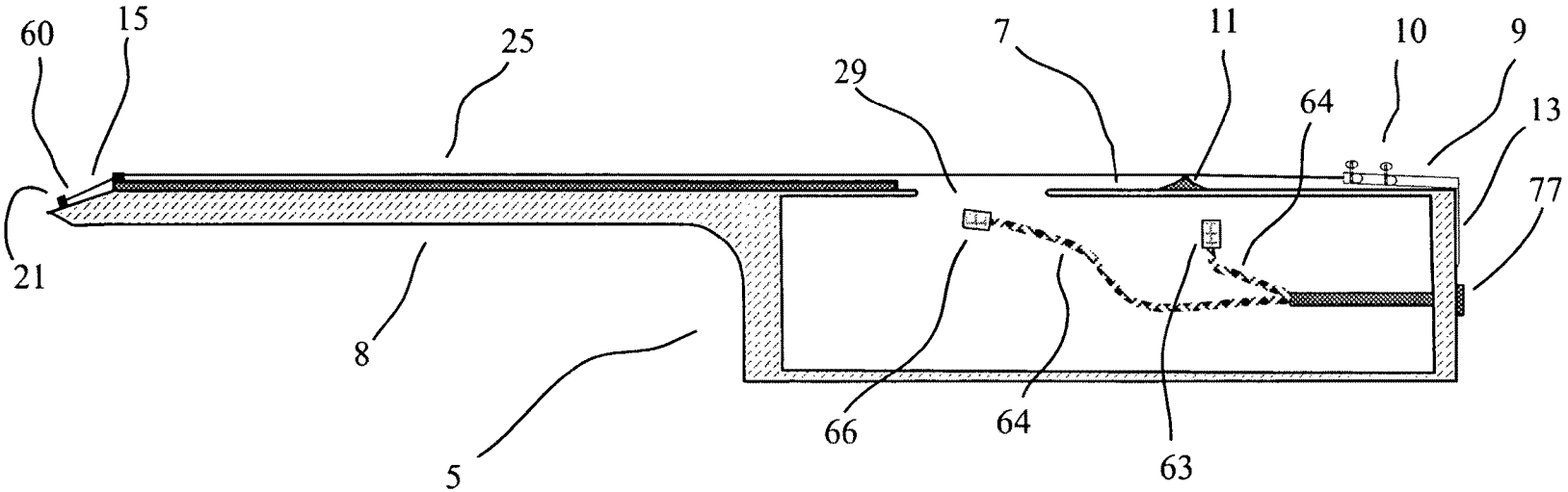
FIG. 14 is a side cross sectional view of a musical instrument according to an embodiment.
Figure 24:
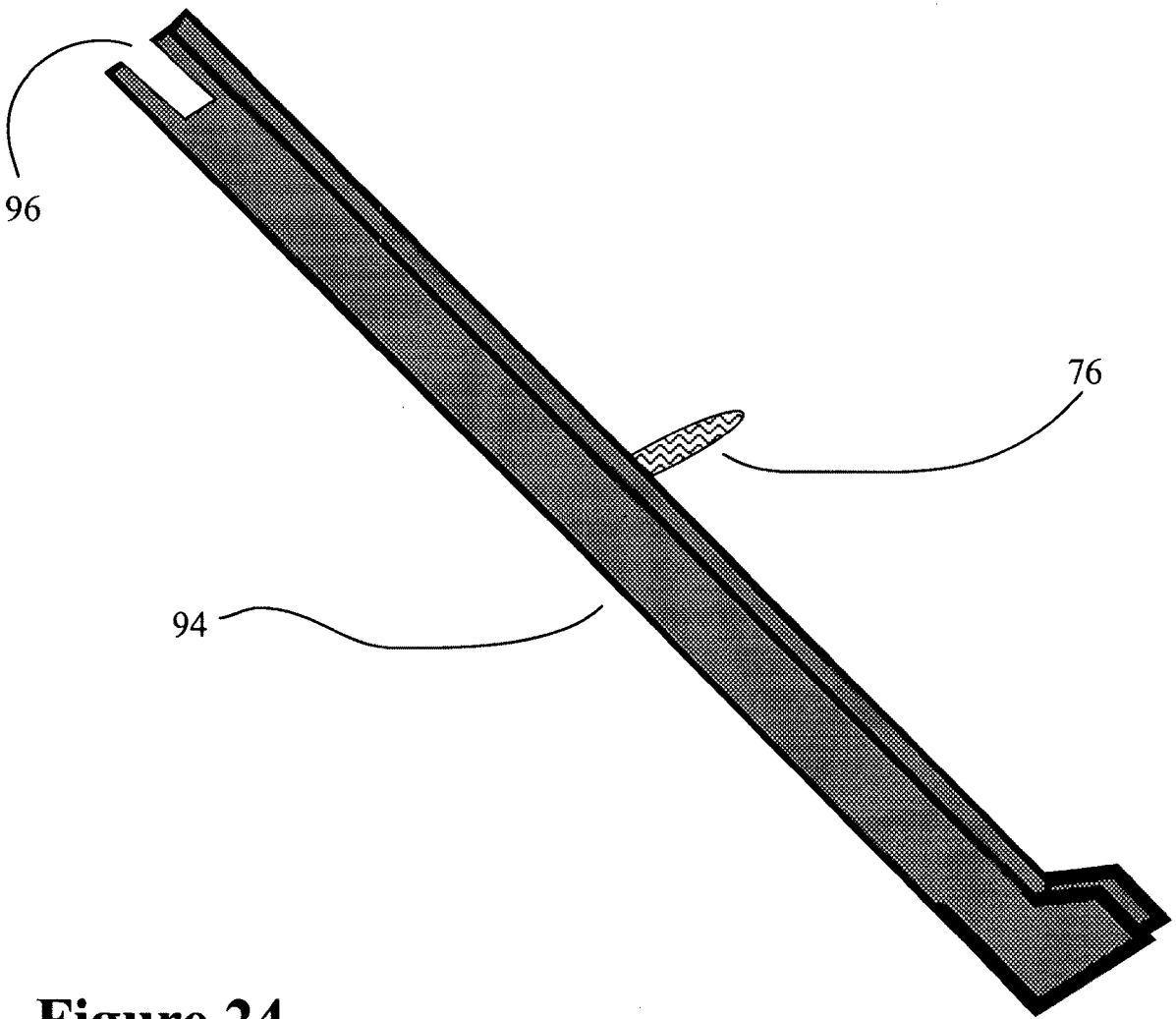
FIG. 24 is a detailed view showing one example of a removable thumbrest that may be included in the embodiments.

Referring back to FIG. 1, a string 15 may be attached to a position opposite a tailpiece 9. As but a few of the many possible approaches, a knot, ball, or loop 60 may be formed into the end of the string opposite the tailpiece 9, and this knot, ball or loop 60 may be received by a device such as a pin 21, slot, or other mechanical device that is positioned at the end of the neck structure 8 opposite the soundbox 6 (this arrangement is also shown in FIGS. 14 and 24). Once the string 15 is attached to both the tuner 10 and pin 21 strings 15 may be tensioned. One example of a tensioning approach includes:

1. the strings 15 are positioned to pass over a bridge 11 resting on the sound board 7, 2. the tuning button 54 may tension the string 15, and 3. the opening 55 in the tuning button 54 may receive an adjusting tool 83 for further tensioning of the strings.

Referring back to FIGS. 9-13, a tailpiece 9 may be composed with a "staggered" design so that the first hole 45, second hole 41, and slot 43 for each string 15 can be positioned towards the edge of the tailpiece 9 for the outer strings, and towards the center of the tailpiece 9 for the middle strings. Such staggering may allow the strings 15 to pass freely through the second holes 45 drilled into the end of the tailpiece 9, and pull directly against the main shafts 47 of the tuners 10 to achieve an efficient transfer of tension from the strings 15 to the tailpiece 9. The tailpiece 9 may be secured to a hinge 13 or similar mechanism, and this hinge 13 may be secured to the sound box 6 with mechanisms such as screws 49 or similar fasteners.

It is noted that while embodiments shown herein depict the use of four strings, more strings, or fewer strings, may be employed with various other stringed instruments using the tailpiece (e.g., 10) and neck structure (e.g., 8) designs shown herein, or equivalents. In addition, the particular type of tuners shown, should not necessarily be construed as limiting. As but one example, as shown in FIG. 12, an alternative to geared tuners 10 may be "planetary" tuners 48 that have the tuning shaft 53 approximately inline with the main shaft 47.

In this way, a stringed musical instrument may include a tailpiece having string tensioning equipment in various configurations.

While some embodiments may include musical instruments, and portions thereof, such as tailpieces, other embodiments can include transducer assemblies for musical instruments. Examples of such transducer assembly embodiments are shown in FIGS. 14 to 22.

FIG. 14 shows a side view of a stringed musical instrument 5 with a first transducer assembly installed, and where a first microphone element 63 is mounted on the end of a shorter flexible shaft 64, or gooseneck to record acoustical energy generated by the soundboard 7, and a second microphone element 66 is mounted on the end of longer gooseneck 64 to record acoustical energy dispersing through the soundhole 29. Both microphones (63 and 66) may communicate directly with an output jack 77 that may convert the two separate microphone signals into a single electronic output signal. Strings 15 are shown attached to the tuners 10 on the tailpiece 9 at one end, and to the pin 21 at the opposite end of the neck structure 8, and the strings 15 pass over a bridge 11 that rests on the soundboard 7.

Figure 15:
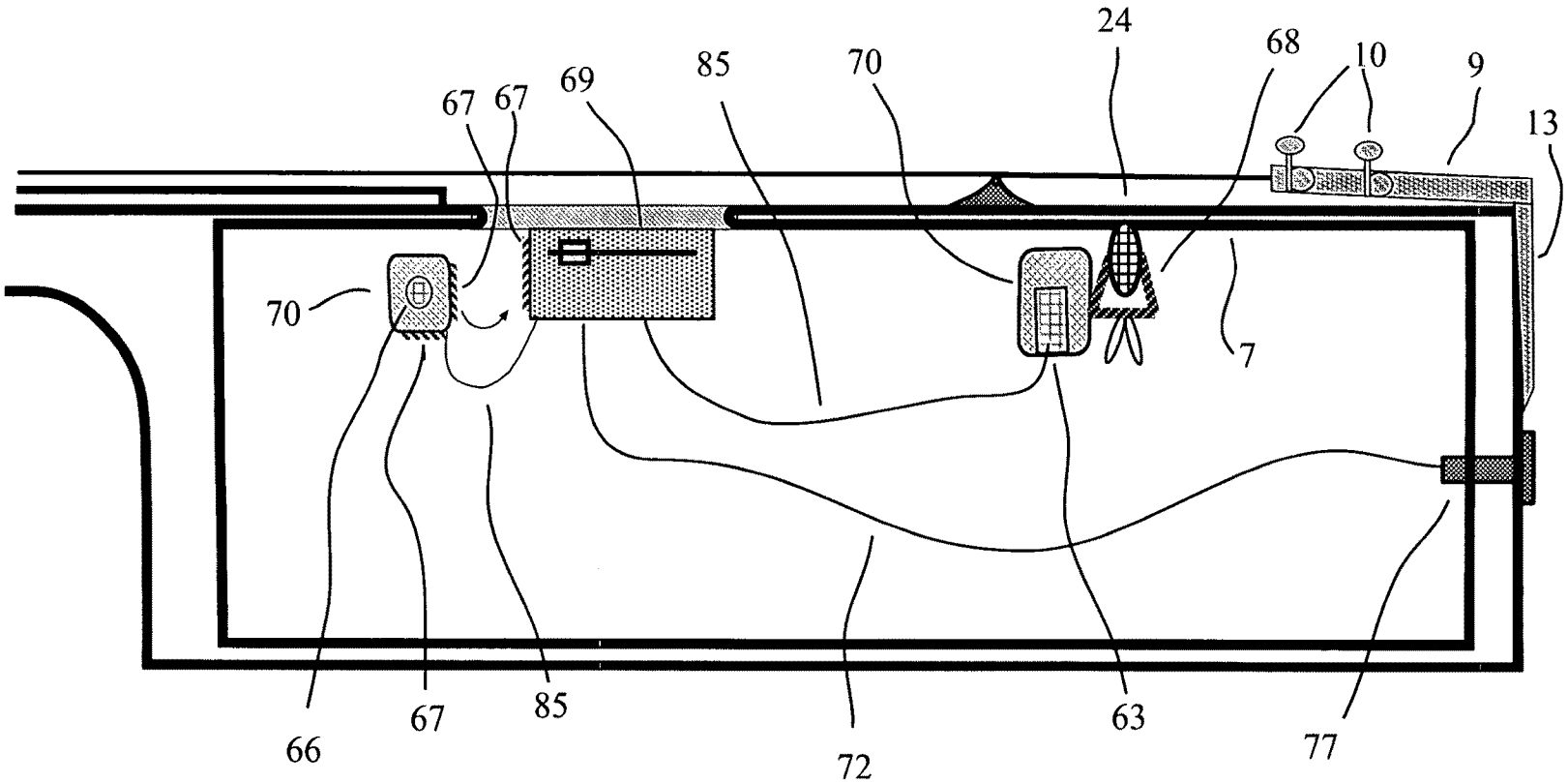
FIG. 15 is a side cross sectional view of a musical instrument according to a further embodiment.

FIG. 15 shows an alternate first transducer assembly that may include two microphone elements (63 and 66) within foam enclosures 70. A separate service module 69 may also be included with which both microphone elements (63 and 66) can communicate and in which signals from such microphone elements may be combined into a single output signal. Such a single output signal may be carried within one output signal cable 72 that may communicate with an output jack 77. In one particular approach, microphone elements (63 and 66) may be secured using a clip mechanism 68, or hook and loop fasteners, as but a few examples.

Figure 16:
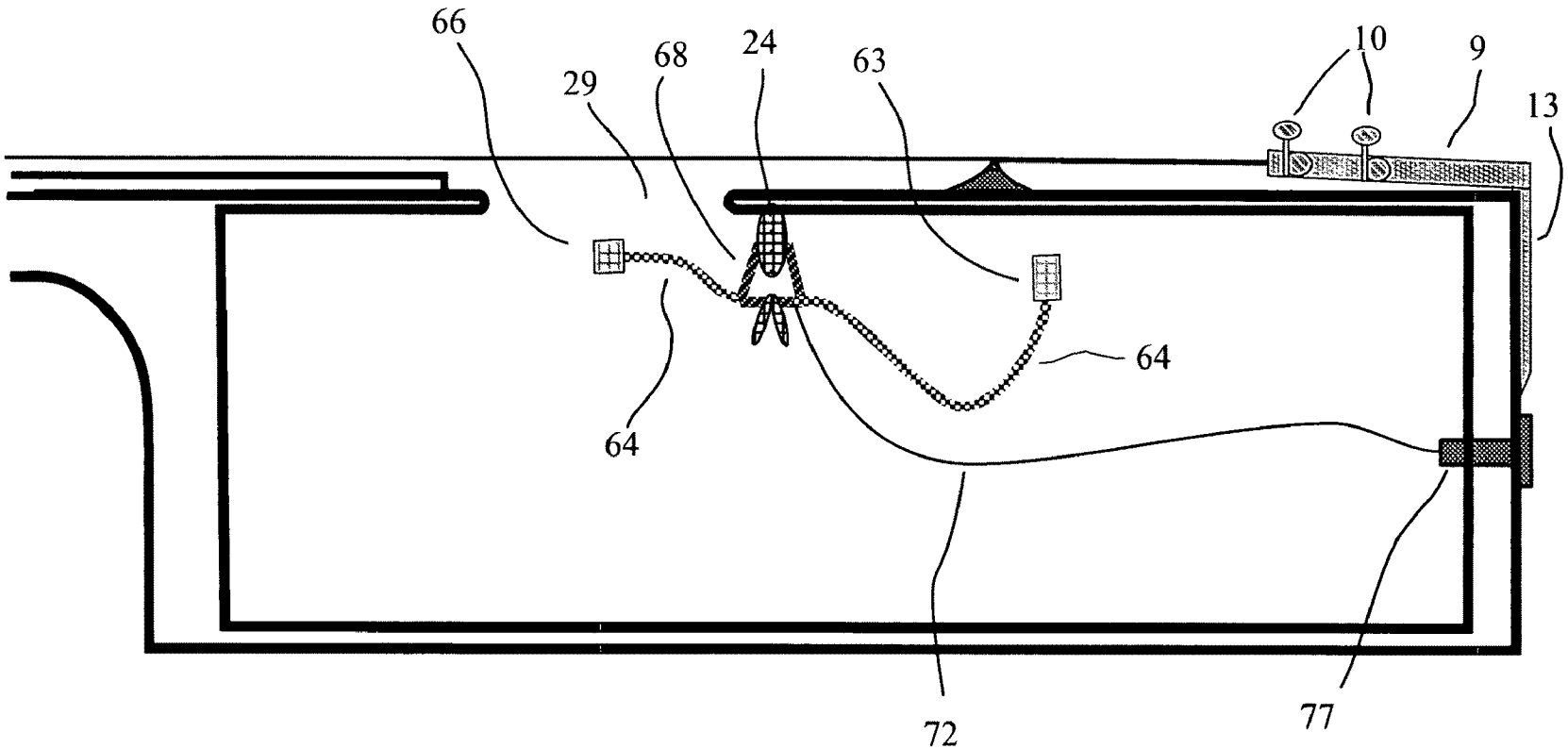
FIG. 16 is a side cross sectional view of a musical instrument according to yet another embodiment.

FIG. 16 shows a further example of a first transducer assembly according to another embodiment. A first transducer assembly may include a first microphone element 63 mounted onto a longer flexible shaft 64, and a second microphone element 66 mounted onto a shorter flexible shaft 64, with a single output cable 72 communicating with an output jack 77. Both flexible shafts 64 may be secured to a clip mechanism 68 that can be attached to a soundboard brace.

Figure 17:
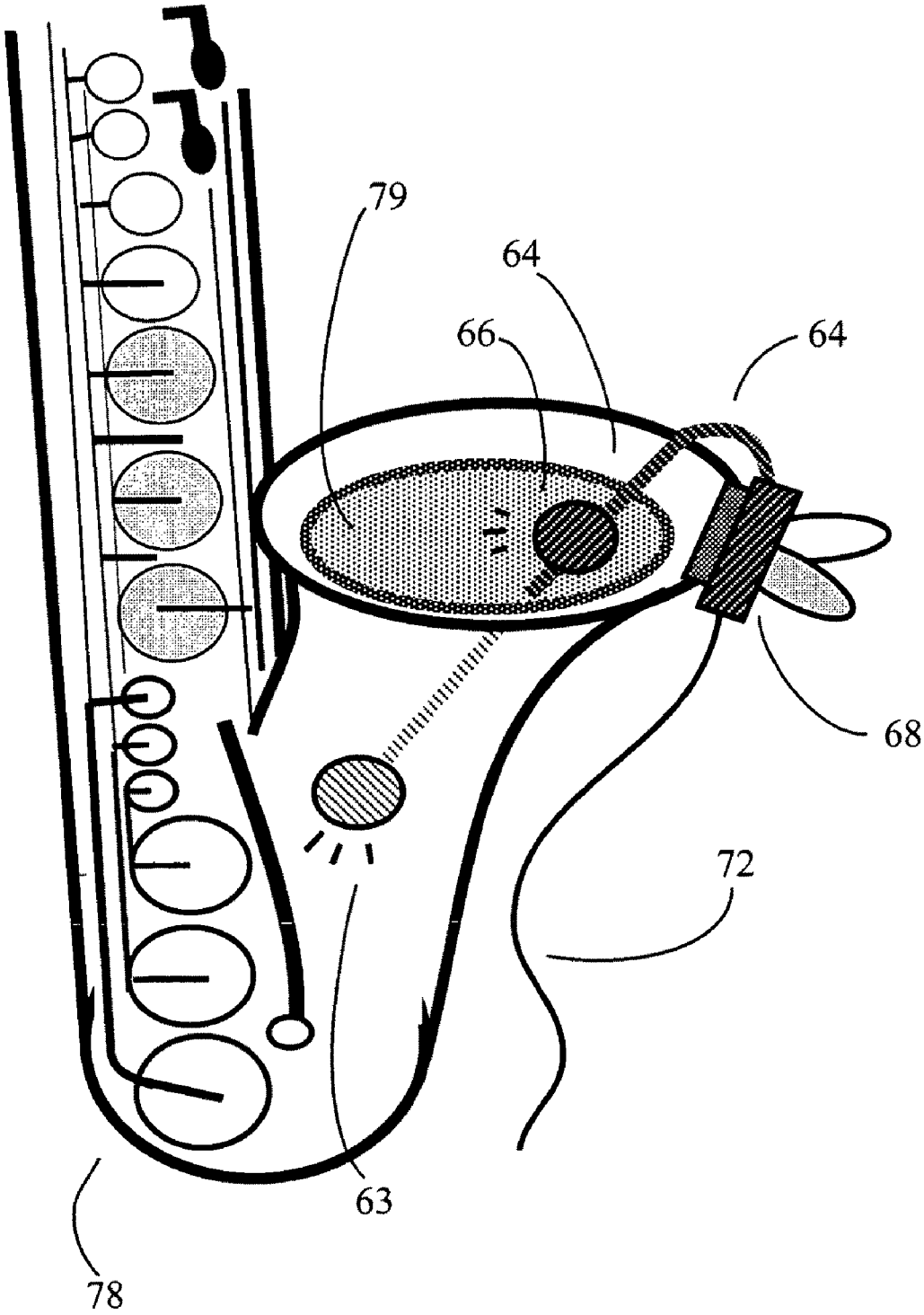
FIG. 17 is a diagram of a musical instrument according to still another embodiment.

FIG. 17 shows another first transducer assembly according to an embodiment. In the example of FIG. 17, a first microphone element 63 may be formed within a foam enclosure on the end of a flexible shaft 64 inside the body of an instrument 78 (in this case a saxophone). A second microphone element 66 may be formed within a foam enclosure located outside the soundhole 79 and attached to the side of the flexible shaft 64, with a clip mechanism employed to secure the flexible shaft 64 to the saxophone 78.

Figure 18:
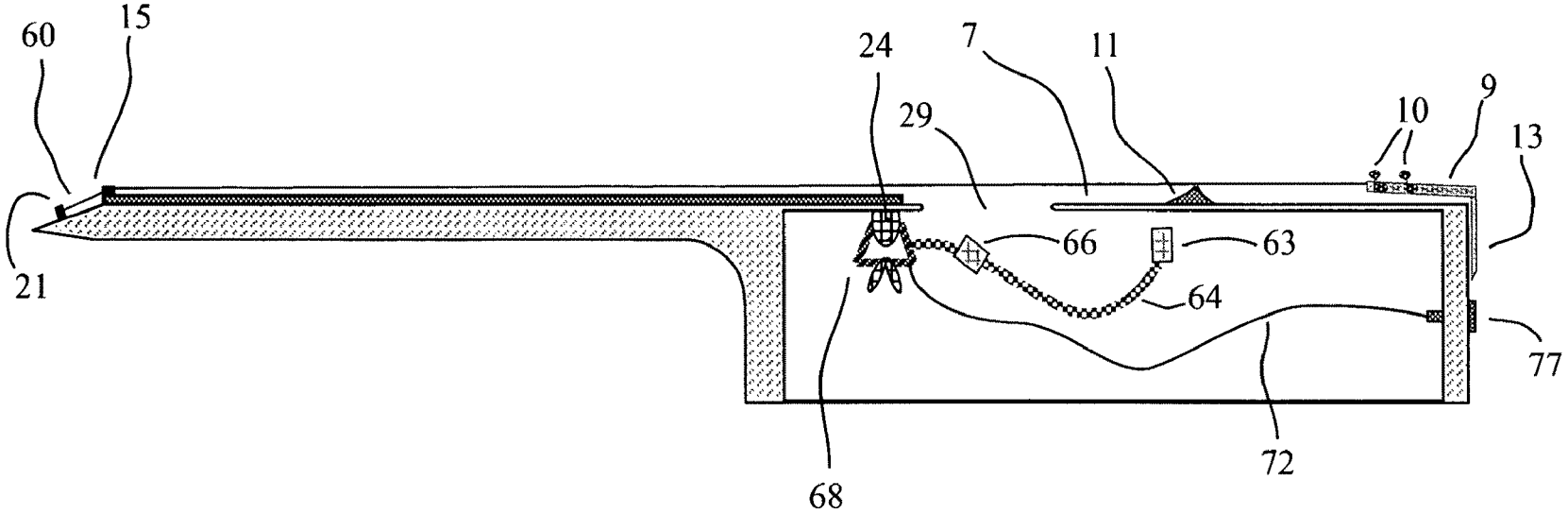
FIG. 18 is a side cross sectional view of a musical instrument according to another embodiment.

FIG. 18 shows a further first transducer assembly with a flexible shaft 64 secured to a clip mechanism 24 that is mounted to an internal component of a musical instrument. The first transducer assembly shown may include a first microphone element 63 mounted on the end of the flexible shaft 64 and a second microphone element 66 mounted on the side of the flexible shaft 64.

Figure 19:
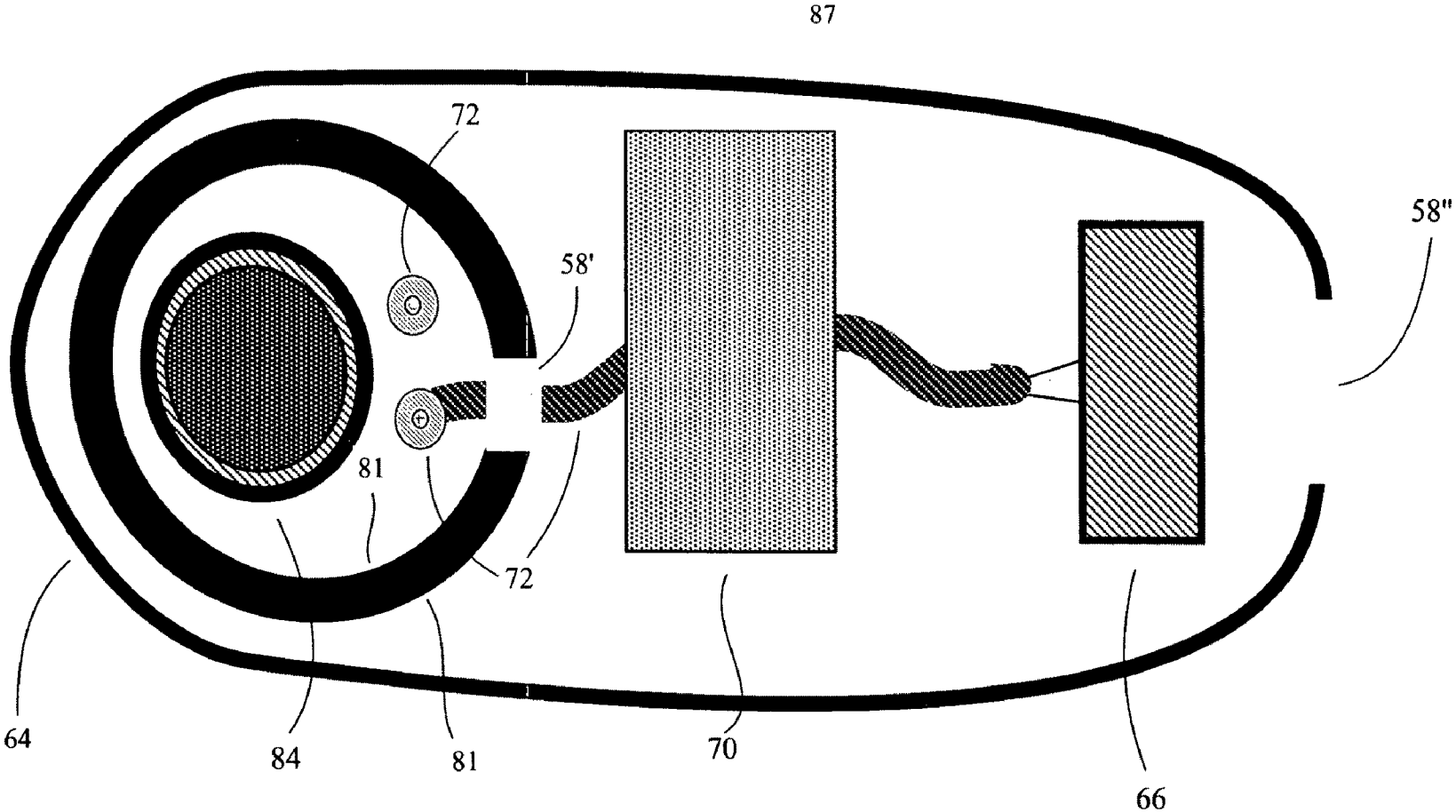
FIG. 19 is an exploded sectional view of a second microphone element that may be included in various embodiments.
Figure 22:
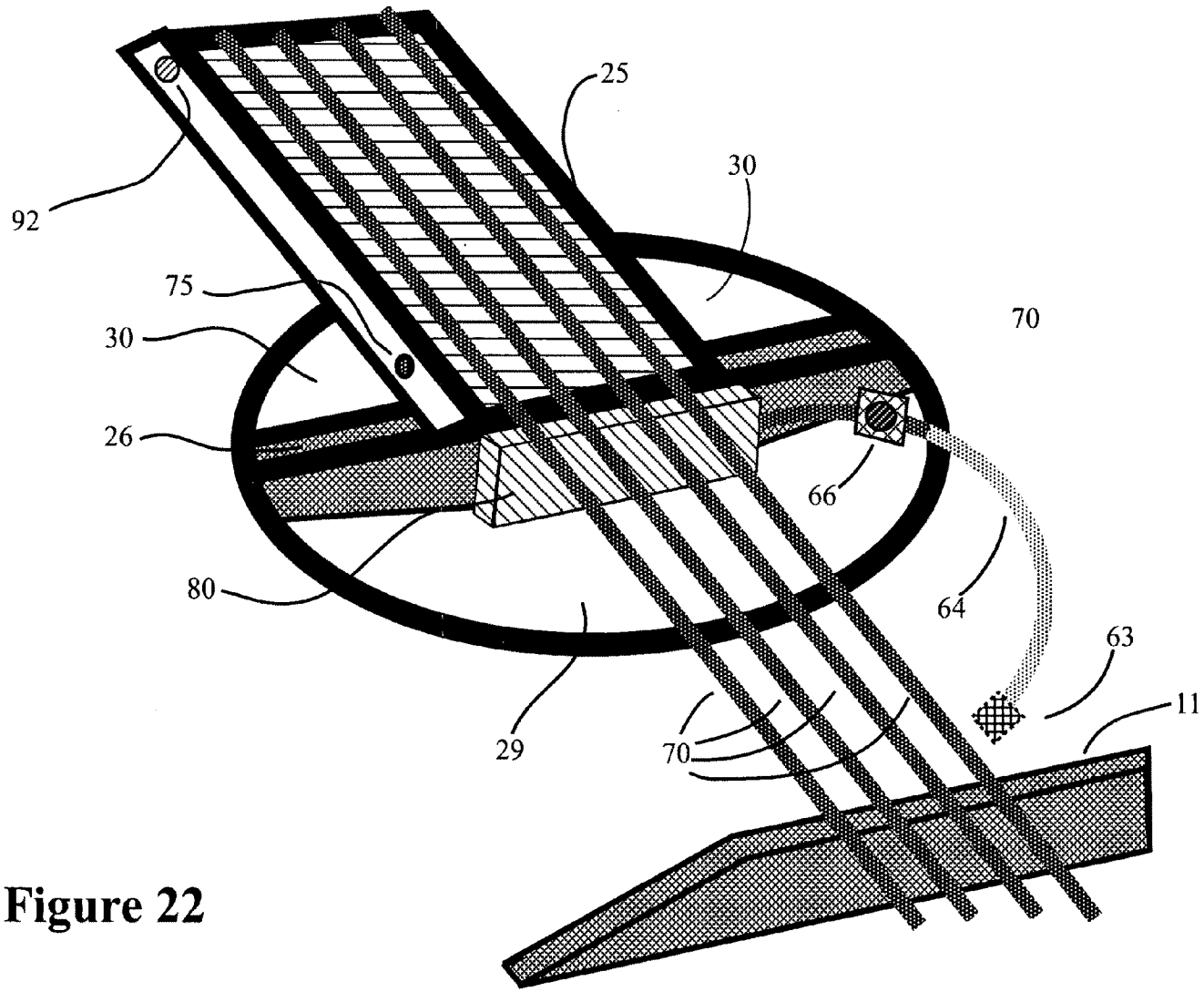
FIG. 22 is a perspective view of a musical instrument according to yet another embodiment.

FIG. 19 shows an exploded cross section view of a second microphone element, like that shown as 66 in FIGS. 17, 18, and 22 that may be secured to a flexible shaft that embodies two separate output cables 72, a stiffening rod 84, an outer covering 81 with an opening 58' through which one of the output cables may be connected to the second microphone element 66, a foam enclosure 70 in the form of a tube to receive the second microphone element 66, and a sheath of shrink tubing 87 that embodies an opening 58" for the second microphone element 66 to receive acoustic energy.

Figure 20:
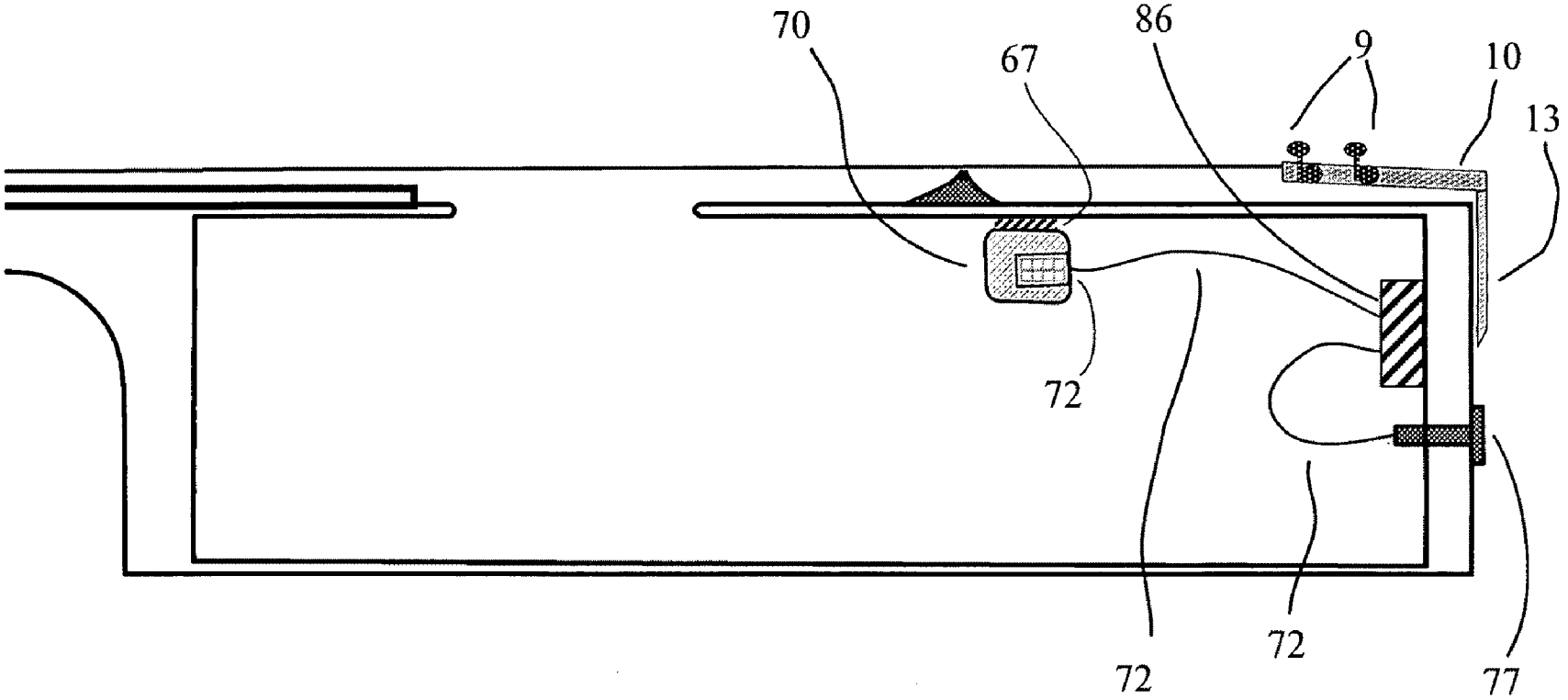
FIG. 20 is a side cross sectional view of a musical instrument according to another embodiment.

FIG. 20 shows another first transducer assembly where one microphone element 66 may communicates with a signal loop generator 86. The signal loop generator 86 may further communicates with an output jack 77.

Figure 21:
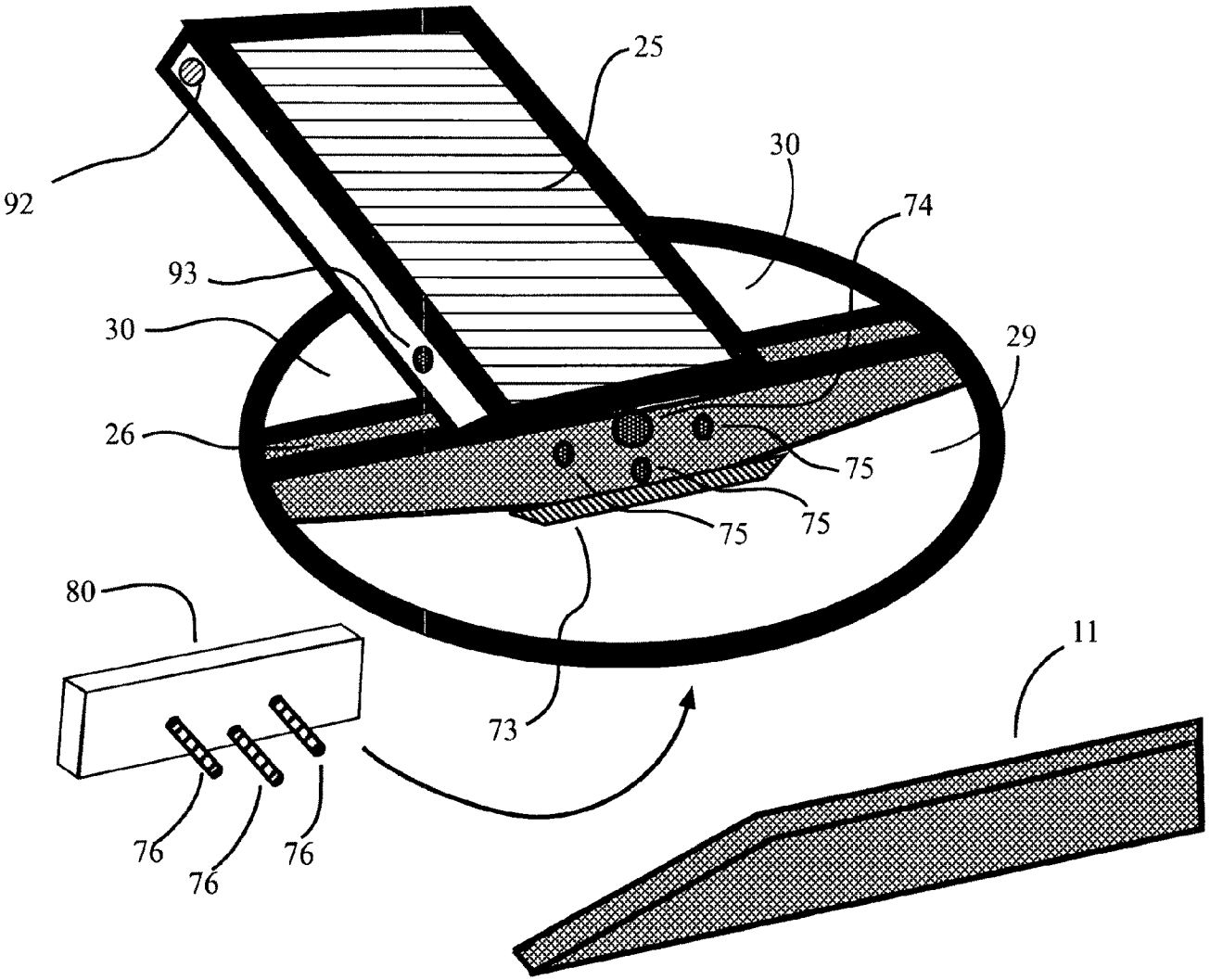
FIG. 21 is a perspective view of a musical instrument according to a further embodiment.

FIG. 21 shows a second transducer assembly according to an embodiment. In the particular example shown, a second transducer assembly may include three conductive posts 76 which may be joined to three conductive inserts 75 of an instrument. An overbrace 73 may be bonded across a lateral brace 26 where the conductive inserts 75 may be positioned. In the very particular case of FIG. 21, a fourth opening 74 may exist in the lateral brace 26 that may receive a tool to adjust a truss rod mechanism (not shown) typically located underneath the fingerboard 25.

FIG. 22 shows an embodiment in which a first transducer assembly and second transducer assembly may be combined. In the arrangement shown, a first microphone element 63 may be mounted on the end of the flexible shaft 64 and a second microphone element 66 may be mounted on the side of the flexible shaft 64.

4. Transducer Assemblies: Having described various examples of transducer assemblies, various aspects of transducer assemblies will now be described with reference to FIGS. 14-22.

According to particular embodiments, two separate transducers can be mounted directly onto, or within, a musical instrument, such as stringed musical instrument 5, and may be modified for creating a variety of amplified musical tones. According to one aspect of the embodiments, a first transducer assembly may include any of:

a. a first microphone element 63 that may be mounted to immediately receive the acoustical energy from the center of the soundboard 7, b. a second microphone element 66 that may be mounted to receive the acoustical energy which disperses through the soundhole 29, c. separate microphone signals from different microphone elements (62 and 66) on two microphone cables 85 may be joined to become a single output signal that may be transported from the musical instrument in any of a number of ways (e.g., wirelessly, or within one electronic output signal cable 72), d. microphone elements 63 and 66 may be mounted and correctly positioned by various mechanical devices, including but not limited to clips 68, hook and loop fasteners 67, metal or fabric webbing 71, mounting arms, including flexible shafts 64 that may enclose a microphone signal cable 85, and/or foam enclosures 70, and e. a service module 69 that may electronically assist the microphone elements 63 and 66.

According to particular embodiments, positioning of the first 63 and second microphone element 66 within or around the musical instrument may create a time delay of approximately 0.000666 of a second between when the first microphone element 63 records the acoustical energy produced by the soundboard 7, and when the second microphone element 66 records acoustical energy dispersing through a soundhole 29. This time delay may improve the overall tone qualities re-produced, and can increase the abilities of both microphone elements 63 and 66 to reject a feedback loop.

For some musical instruments, a first microphone element 63 may be mounted on the end of a flexible shaft 64, and the second microphone element 66 may be mounted to the side of the flexible shaft 64 so that the acoustical sound energy of the musical instrument may be recorded by the two microphone elements 63 and 66 with a 0.000666 of a second time delay see for example FIGS. 17 and 18.

In the case of FIG. 17, a saxophone 78 is shown with a first microphone element 63 mounted on the end of a flexible shaft 64 and positioned inside the body of the saxophone 78. A second microphone element 66 may be mounted on the side of this same flexible shaft 64 to record the acoustical sound energy outside of the soundhole 79.

One example of a second microphone element, like that shown as 66 in FIGS. 17, 18, and 22 is shown in FIG. 19. In the embodiment of FIG. 19, a second microphone element 66 may be attached to the side of a flexible shaft 64 composed of an outer covering 81 which may enclose two output cables 72 and stiffening rod 84. An opening 58' in the outer covering 81 may permit one output cable 72 to communicate with the second microphone element 66. A foam enclosure 70 may receive the second microphone element 66, and a sheath of shrink tubing 87 may surround such elements, and include an opening 58". Shrink tubing may be reduced to bond the output cable 72, second microphone element 66, and foam enclosure 70, to the side of the flexible shaft 64, while the opening 58" in the shrink tubing 87 may permit the second microphone element 66 to receive and record acoustic sound energy.

Referring to FIG. 20, a further variation is disclosed that uses a first microphone element 63, with the output signal cable 72 communicating with an electronic signal loop generator 86. This signal loop generator 86 can re-insert the electronic signal generated by the microphone element 63 into the output signal cable 72 with a time delay approximately 0.000666 of a second after the signal first passes through the output signal cable 72, and thus can reduce the potential of a feedback loop being generated.

Having described various first transducer assemblies, examples of second transducer assemblies will now be described.

Referring to FIGS. 21 and 22, the second transducer 80 may convert the movement of the strings 15 into an electronic signal for output from musical instrument 5. In the example of FIGS. 21 and 22, second transducer 80 may include three conductive mounting posts 76 arranged into a triangular pattern that may be joined to three conductive inserts 75 which are arranged in a corresponding triangular pattern. The conductive inserts 75 may enable second transducer 80 to communicate with other electronic structures/devices, including an output jack 77 (not shown in FIGS. 21 and 22). The conductive inserts 75 may be formed within the first lateral brace 26 so that the transducer 80 may communicate with other structures/devices through soundhole 29. As shown in FIG. 22, when conductive mounting posts 76 are inserted into the conductive inserts 75, the second transducer 80 will be securely positioned in close proximity to the strings 15. In the embodiment shown, the conductive inserts 75 may partially encircle a separate hole 74 typically located in this first lateral brace 26 that is employed to receive an adjustment tool (not shown) for a truss rod mechanism (not shown) located under the fingerboard 25. Because holes for the conductive inserts 75 and truss rod adjustment tool 74 may result in lateral brace having less structural strength than a corresponding structure without holes. If desired, an over-brace 73 may be affixed to the first lateral brace 26 to thereby provide a structure having even greater structural strength.

Referring to FIG. 22, first and second transducers assemblies, like those described above and equivalents, may be combined. In one such arrangement, a flexible shaft 64 may be attached to the body of the second transducer 80 with a first microphone element 63 mounted to the end of the flexible shaft 64 to record acoustical energy near the soundboard 7. A second microphone element 66 may be mounted on the side of the flexible shaft 64 to record the acoustic energy dispersing through the soundhole 29.

In this way, a musical instrument may include one or more transducer assemblies, including a transducer assembly that can generate two electronic signals in response to a same acoustic energy, where one electronic signal has a predetermined delay with respect to the other.

While some embodiments may include musical instruments, portions of such instruments, as well as transducers therefor, other embodiments may include dampening devices for musical instruments. A very particular example of one such embodiment is shown in FIG. 23.

Figure 23:
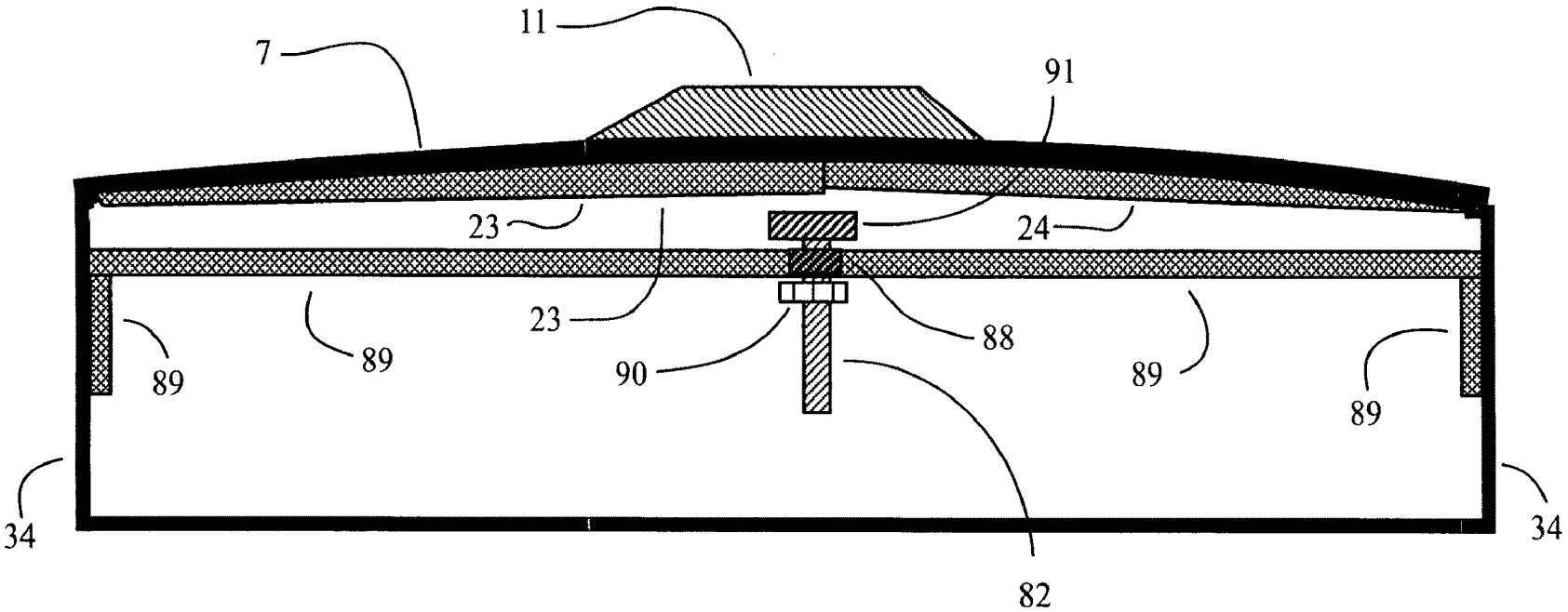
FIG. 23 is a cross sectional view of musical instrument according to another embodiment.

FIG. 23 shows a cross section view of a musical instrument 7 (in this example, a stringed musical) with a dampening device. Such a dampening device may be installed within a cross support 89 that spans between the ribs 34, and does not contact any part of the soundboard 7. A locking nut 90 may secure the dampening device in place.

5. Dampening device for soundboard: Features of a dampening device according to one particular embodiment will now be described.

Referring to FIG. 23, a dampening device may include a threaded post 82 received by a threaded insert 88 affixed to a cross support 89 composed of rigid materials that is attached to the ribs 34, and does not contact any part of the soundboard 7. An end of the post 82 nearer the braces 23 may include a series of interchangeable fittings (one shown as 91) of different shapes and materials.

In one particular example, a soundboard 7 may have a structure like that shown in FIG. 4 or 5, and a threaded post 82 may be adjusted so that a fitting 91 may, or may not, contact the triangle where the two X braces 23 and second lateral brace 24 over lap and under lap in order to alter the vibrating patterns of the soundboard 7 and reduce the production of musical tones that may generate a feedback loop. A locking nut 90 attached to the post 82 can secure the post 82 and fittings 91.

In this way, a musical instrument having a sound generating body, may include a dampening structure formed therein.

While some embodiments may include musical instruments, portions thereof and transducers therefor, other embodiments may include a unique removable thumbrest for musical instruments. Particular examples of such embodiments are shown in FIGS. 24 to 26.

FIG. 24 shows a detailed view of one example of a removable thumbrest 94 with a slot 96 at one end, and a conductive mounting post 76 in the middle.

Figure 25:
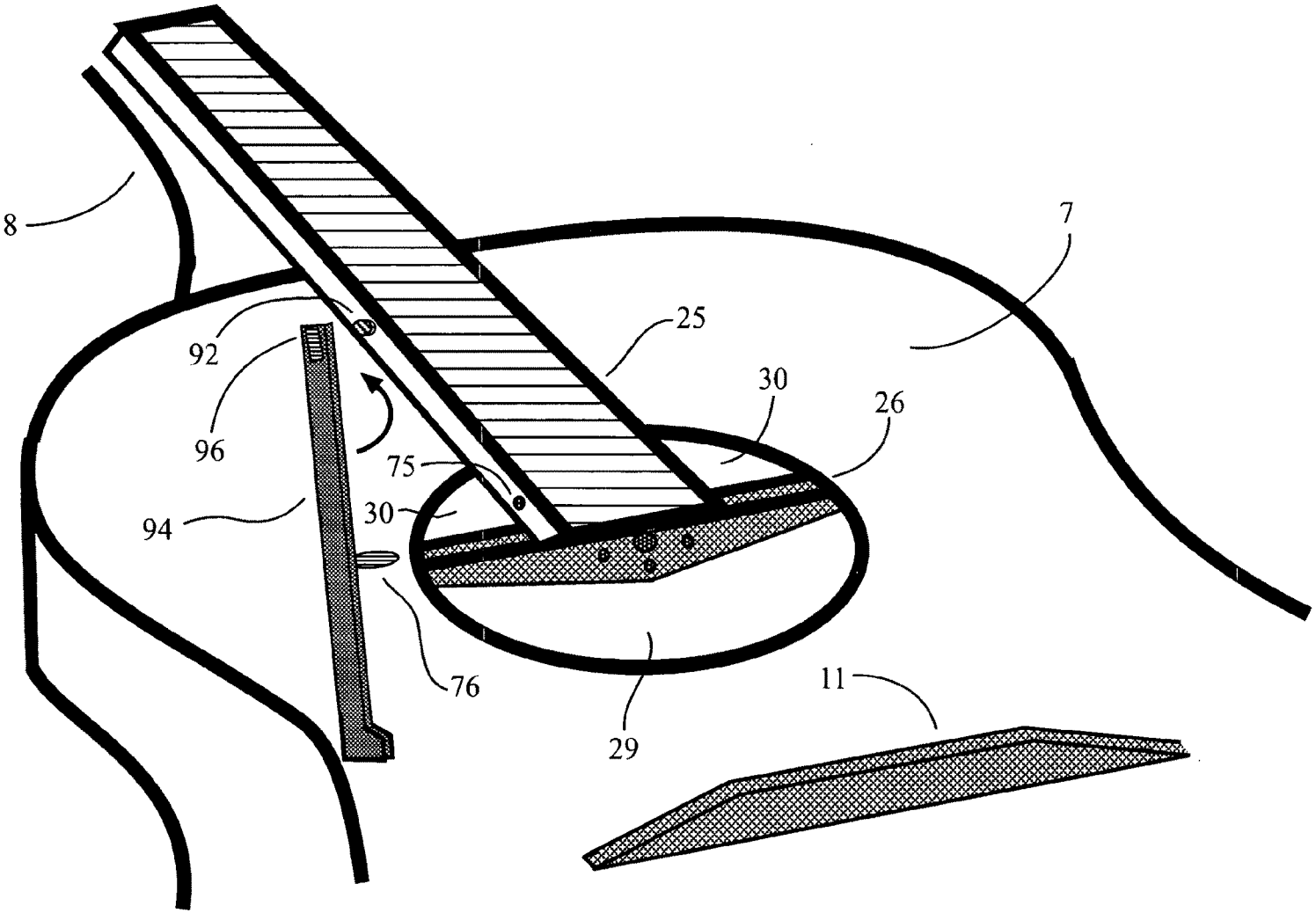
FIG. 25 is perspective view of a musical instrument according to one embodiment that may accommodate the removable thumbrest of FIG. 24.

FIG. 25 shows the removable thumbrest of FIG. 24 ready to be installed to a fingerboard 25 of a stringed musical instrument.

Figure 26:
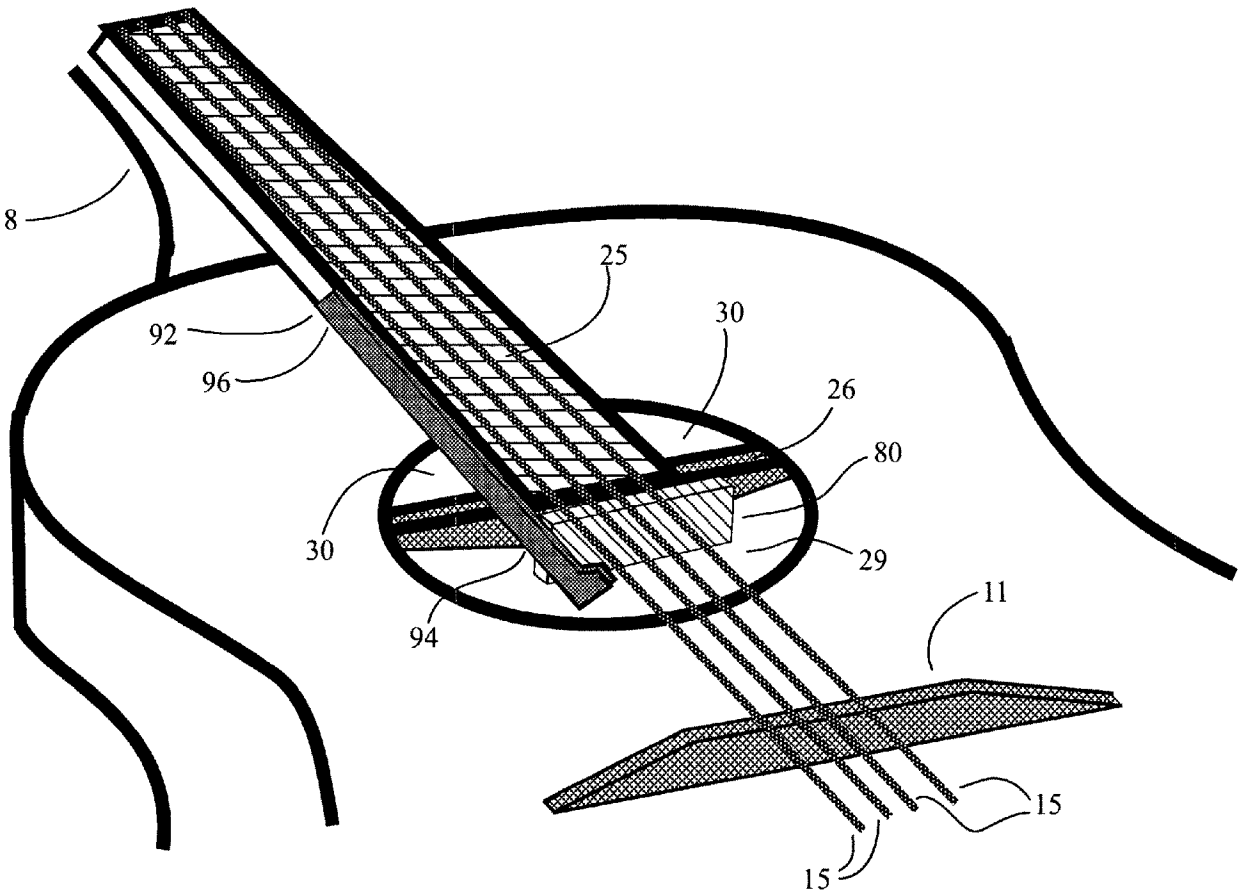
FIG. 26 shows the musical instrument of FIG. 25 with the removable thumbrest of FIG. 24 in place.

FIG. 26 shows the thumbrest of FIGS. 24 and 25 installed on a stringed musical instrument. In the example shown, removable thumbrest may function as a grounding device for a second transducer 80.

6. Detachable thumbrest: Features of a detachable thumbrest according to one particular embodiment will now be described.

Referring to FIGS. 24-26, a thumbrest 94 may be attached to a neck structure 8 of a stringed musical instrument, typically along the bass side of the fingerboard 25. Removable thumbrest may be easily removed or installed as shown in FIGS. 24, 25, and 26). The thumbrest 94 may include attachment mechanisms, which in the example shown, include a slot 96 that may be received by a headed pin 92 formed on a side of fingerboard 25. The thumbrest 94 may also include conductive mounting post 76 that can be received by a conductive insert 75 mounted in the side of the fingerboard 25. In particular embodiments, this conductive insert 75 may be electronically connected to the ground system for a transducer 80, and thumbrest 94 may be composed, at least in part, of an electronically conductive material. This can enable a thumbrest 94 to function as a grounding device to reduce 60-cycle hum from the transducer 80.

In this way, a removable thumbrest can be attached to a side of a stringed musical instrument fingerboard, and in particular arrangements, can form part of a ground path.

While some embodiments may include tailpieces or thumbrests for stringed musical instruments, other embodiments may include an overlay structure, for altering a fretted fingerboard into a fretless surface. On such embodiment is shown in FIG. 27.

Figure 27:
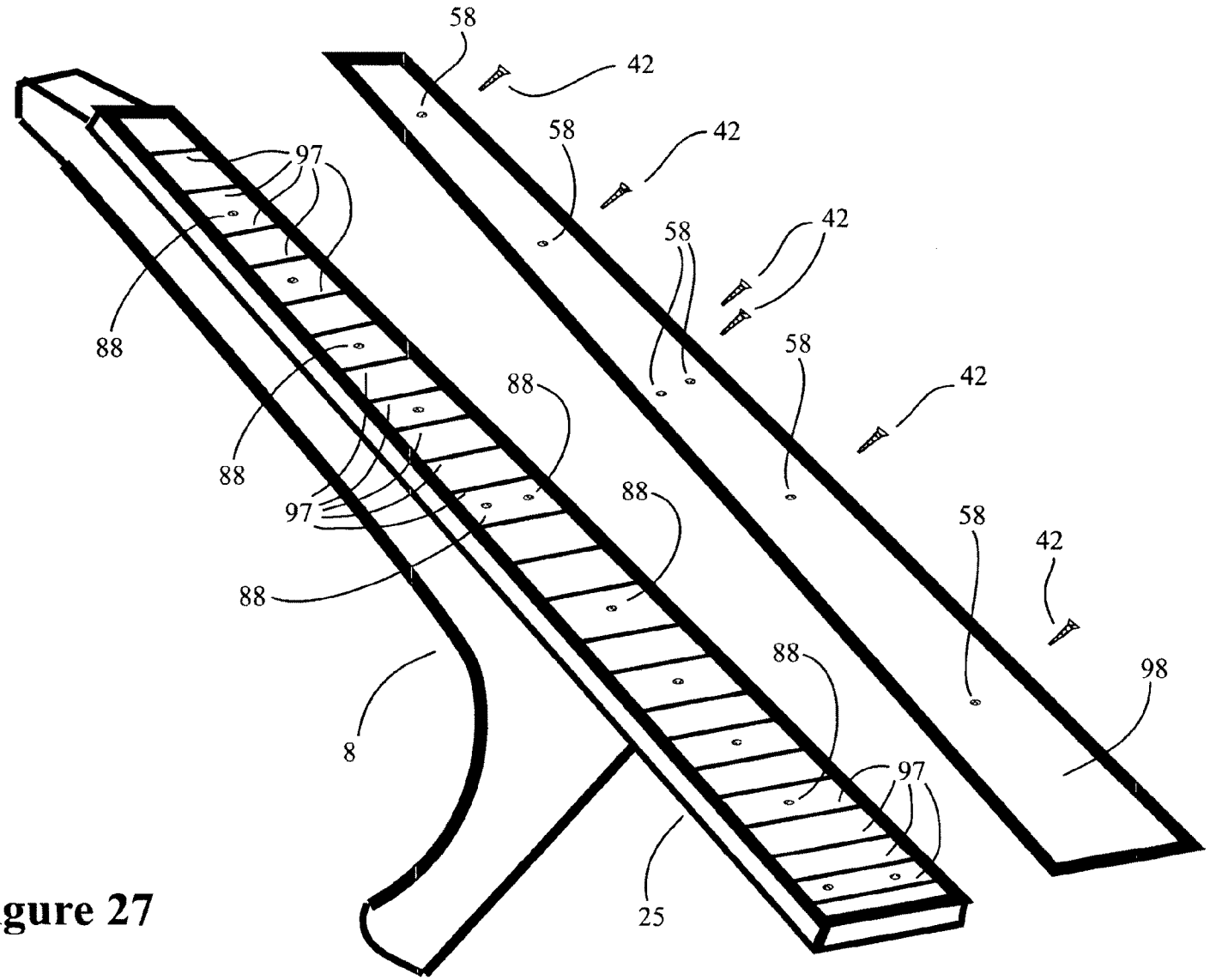
FIG. 27 shows a rigid overlay is positioned to be installed over the original fretted fingerboard so that the surface which contacts the strings will become fretless.

FIG. 27 shows a view of the neck structure 8 of a stringed musical instrument where a rigid overlay 98 can be installed over an original fretted fingerboard 25 so that the surface which contacts the strings will become fretless.

7. Rigid Fingerboard Overlay: Various aspects of an overlay structure according to an embodiment will now be described.

Referring to FIG. 27, a neck structure 8 may employ a fingerboard 25 with frets while a rigid overlay 98 may temporarily convert the fretted fingerboard 25 into fretless structure. The rigid overlay 98 may be contoured to match the dimensions and curvature of the fingerboard 25, so that it may be secured by mechanical devices, such as machine screws 42 received by threaded inserts 88, as but one example. If threaded inserts 88 are placed in the same location as standard position markers, there may be no change in the visual appearance of the fingerboard 25 when the rigid overlay 98 is not attached.

In this way, a rigid overlay may be temporarily attached to a fretted fingerboard to form a fretless surface for such an instrument.

Embodiments of the present invention are well suited to performing various other steps or variations of the steps recited herein, and in a sequence other than that depicted and/or described herein.

For purposes of clarity, many of the details of the various embodiments and the methods of designing and manufacturing the same that are widely known and are not relevant to the present invention have been omitted from the following description.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

It is also understood that the embodiments of the invention may be practiced in the absence of an element and/or step not specifically disclosed. That is, an inventive feature of the invention can be elimination of an element.

Accordingly, while the various aspects of the particular embodiments set forth herein have been described in detail, the present invention could be subject to various changes, substitutions, and alterations without departing from the spirit and scope of the invention.

What is claimed is:

1. A musical instrument, comprising:

a neck structure coupled to a soundbox that is configured to receive at least one string;

a soundboard of the soundbox having at least one opening formed therein that is intersected by one of a plurality of support cross members and a portion of the neck structure, the one supporting cross member being disposed on an inner surface of the soundbox;

a tailpiece coupled to the soundbox opposite to the neck structure, the tailpiece including tuners that receive and tension the at least one string;

at least a first transducer assembly that generates at least two electronic signals, generated in response to sounds of the musical instrument, and having a pre-determined time delay with respect to one another; and at least one strengthening overbrace that is bonded to at least one supporting cross member that spans the at least one opening, the overbrace configured to mechanically connect to a removable transducer mechanism.

2. The musical instrument of claim 1, wherein:

at least one of the supporting cross members comprises a void containing material bonded to two rigid materials.

3. The musical instrument of claim 1, wherein:

the at least one opening is divided by one of the supporting cross members into a first opening portion and second and third opening portions that are smaller than the first opening portion, the second and third opening portions being positioned along opposite sides of the neck structure.

4. The musical instrument of claim 1, further including:

a removable cover configured to rigidly attach to said sound box and seal a side opening that is attached only to the lower treble region of said musical instrument.

5. The musical instrument of claim 1, further including:

a dampening structure including an adjustable member to apply selective pressure to at least one of the supporting cross members.

6. The musical instrument of claim 5, wherein:

the dampening structure includes a locking nut to secure a position of the adjustable member which contacts and applies selective pressure to the at least one supporting cross member.

7. The musical instrument of claim 1, further including:

an overlay structure detachably connected to the neck structure having a fingerboard surface different from said neck structure.

8. The musical instrument of claim 1, wherein:

the at least first transducer assembly combines the at least two electronic signals to form a single electronic output signal.

9. The musical instrument of claim 1, further including:

a second transducer assembly mounted beneath the at least one string that generates a second transducer electronic signal in response to movement of the at least one string.

10. The musical instrument of claim 9, wherein:

the second transducer assembly includes a plurality of rigid, conductive posts insertable into receiving holes of the musical instrument.

11. A musical instrument, comprising:

a neck structure coupled to a soundbox that is configured to receive at least one string;

a soundboard of the soundbox having at least one opening formed therein that is intersected by one of a plurality of support cross members and a portion of the neck structure;

a tailpiece coupled to the soundbox opposite to the neck structure, the tailpiece including tuners that receive and tension the at least one string;

at least a first transducer assembly that generates at least two electronic signals, generated in response to sounds of the musical instrument, and having a pre-determined time delay with respect to one another; and a removable thumbrest that can be mechanical attached to the neck structure to extend alongside said neck structure and over said soundbox opening.

12. The musical instrument of claim 11, wherein:

the removable thumbrest comprises a conductive material and provides a conductive connection to the neck structure when attached thereto, the conductive connection being connected to a ground path of at least the first transducer assembly.

13. A musical instrument, comprising:

a neck structure coupled to a soundbox that is configured to receive at least one string;

a soundboard of the soundbox having at least one opening formed therein that is intersected by one of a plurality of supporting cross members and a portion of the neck structure;

a tailpiece coupled to the soundbox opposite to the neck structure, the tailpiece including tuners that receive and tension the at least one string;

at least a first transducer assembly that generates at least two electronic signals, generated in response to sounds of the musical instrument, and having a pre-determined time delay with respect to one another, the at least first transducer assembly comprises a first microphone element positioned to convert acoustical energy immediately within the body of a musical instrument to generate a first of the electronic signals, and a second microphone element positioned to convert acoustical energy dispersing through the at least one opening of the soundboard to generate a second of the electronic signals.

14. The musical instrument of claim 13, wherein:

at least one of the supporting cross members comprises a void containing material bonded to two rigid materials.

15. The musical instrument of claim 13, wherein:

the at least one opening is divided by one of the support cross members into a first opening portion and second and third opening portions that are smaller than the first opening portion, the second and third opening portions being positioned along opposite sides of the neck structure.

16. The musical instrument of claim 13, further including:

a removable cover configured to rigidly attach to said sound box and seal a side opening that is attached only to the lower treble region of said musical instrument.

17. The musical instrument of claim 13, further including:

a dampening structure including an adjustable member to apply selective pressure to at least one of the support cross members.

18. The musical instrument of claim 17, wherein:

the dampening structure includes a locking nut to secure a position of the adjustable member which contacts and applies selective pressure to the at least one supporting cross member.

19. The musical instrument of claim 13, wherein:

the at least first transducer assembly combines the at least two electronic signals to form a single electronic output signal.

20. The musical instrument of claim 13, further including:

a second transducer assembly mounted beneath the at least one string that generates a second transducer electronic signal in response to movement of the at least one string.

* * * * *